US005963896A

United States Patent [19]

Ozawa

[11] Patent Number: 5,963,896

[45] Date of Patent: Oct. 5, 1999

[54] SPEECH CODER INCLUDING AN EXCITATION QUANTIZER FOR RETRIEVING POSITIONS OF AMPLITUDE PULSES USING SPECTRAL PARAMETERS AND DIFFERENT GAINS FOR GROUPS OF THE PULSES

[75] Inventor: Kazunori Ozawa, Tokyo, Japan

[73] Assignee: NEC Corporation, Tokyo, Japan

[21] Appl. No.: 08/917,713

[22] Filed: Aug. 26, 1997

[30] Foreign Application Priority Data

Aug. 26, 1996 [JP] Japan ..... 8-261121
Oct. 31, 1996 [JP] Japan ..... 8-307143

[51] Int. Cl.[6] ..... G10L 9/14

[52] U.S. Cl. ..... 704/219; 704/216; 704/223; 704/222; 704/230

[58] Field of Search ..... 704/219, 222, 704/223, 216, 207, 240, 230, 208, 225, 262, 214

[56] References Cited

U.S. PATENT DOCUMENTS

| | | | |
|---|---|---|---|
| 4,022,974 | 5/1977 | Kohut et al. | 704/262 |
| 4,945,567 | 7/1990 | Ozawa | 704/223 |
| 5,208,862 | 5/1993 | Ozawa | 704/216 |
| 5,485,581 | 1/1996 | Miyano et al. | 704/223 |
| 5,487,128 | 1/1996 | Ozawa | 704/222 |
| 5,557,705 | 9/1996 | Taguchi | 704/219 |
| 5,579,433 | 11/1996 | Jarvinen | 704/219 |
| 5,598,504 | 1/1997 | Miyano | 704/222 |
| 5,666,464 | 9/1997 | Serizawa | 704/207 |
| 5,682,407 | 10/1997 | Funaki | 375/240 |
| 5,737,484 | 4/1998 | Ozawa | 704/219 |
| 5,751,903 | 5/1998 | Swaminathan et al. | 704/230 |
| 5,774,837 | 6/1998 | Yeldener et al. | 704/208 |
| 5,774,840 | 6/1998 | Taumi et al. | 704/223 |
| 5,778,334 | 7/1998 | Ozawa et al. | 704/219 |
| 5,787,391 | 7/1998 | Moriya et al. | 704/225 |

FOREIGN PATENT DOCUMENTS

| | | |
|---|---|---|
| 4-171500 | 6/1992 | Japan . |
| 4-363000 | 12/1992 | Japan . |
| 5-6199 | 1/1993 | Japan . |
| WO 95 30222 | 11/1995 | WIPO . |

OTHER PUBLICATIONS

Taumi et al. "Low–delay CELP with multi–pulse VQ and fast search for GSM EFR", vol. 1, May 7–10, 1996 pp. 562–565.

Ozawa et al: "M–LCELP speech coding at 4 KB/S with multi–mode and multi codebook" vol. E77–B, No. 9, Sep. 1, 1994, pp. 1114–1121.

Juang B–H et al: "Multiple Stage Vector Quantization for Speech Coding" vol. 1, May 3–5, 1982, pp. 597–600.

Nakamizo, "Signal Analysis and System Identification", Corona Co. Ltd., 82–87 (1988).

Schroeder et al., "Code–Excited Linear Prediction: High Quality Speech at Very Low Bit Rates", Proc. ICASSP, 937–940 (1985).

Kleijn et al., "Improved Speech Quality and Effective Vector Quantization in SELP:", Proc. ICASSP, 155–158 (1988).

Kroon et al., "Pitch Predictors with High Temproal Resolution", Proc. ICASSP, 661–664 (1990).

Laflamme et al., "16 kbps Wide–Band Speech Coding Technique Based on Algebraic Celp", 13–16 (1991).

Linde et al., An Algorithm for Vector Quantization Design, IEEE Trans. Commun., 84–95 (1980).

*Primary Examiner*—David R. Hudspeth
*Assistant Examiner*—Vijay B. Chawan
*Attorney, Agent, or Firm*—Foley & Lardner

[57] ABSTRACT

In a speech coder, an excitation quantizer 360 retrieves the positions of M non-zero amplitude pulses, which together constitute an excitation, by using spectral parameters and with a different gain for each group of the pulses less in number than M.

23 Claims, 23 Drawing Sheets

SPEECH CODER INCLUDING AN EXCITATION QUANTIZER FOR RETRIEVING POSITIONS OF AMPLITUDE PULSES USING SPECTRAL PARAMETERS AND DIFFERENT GAINS FOR GROUPS OF THE PULSES

BACKGROUND OF THE INVENTION

The present invention relates to a speech coder for high quality coding speech signals at low bit rates.

Systems for high quality coding speech signals are well known in the art, as described in, for instance, W. Schroeder and B. Atal., "Code-Excited Linear Prediction: High Quality Speech at Very Low Bit Rates", Proc. ICASSP, pp. 937–940, 1985 (Literature 1), and Kleijn et al., "Improved Speech Quality and Effective Vector Quantization in SELP:, Proc. ICASSP, pp. 155–158, 1988 (Literature 2). In these prior art systems, on the transmitting side spectral parameters representing a spectral characteristic of a speech signal is extracted from the speech signal for each frame (of 20 ms, for instance) by using linear prediction (LPC). The frame is split into a plurality of sub-frames (of 5 ms, for instance), and adaptive codebook parameters (i.e., a delay parameter corresponding to the pitch period and a gain parameter) are extracted for each sub-frame on the basis of a past excitation signal. The sub-frame speech signal is then pitch predicted using the adaptive codebook. The pitch predicted excitation signal is quantized by selecting an optimum excitation vector from an excitation codebook (or vector quantization codebook), which consists of predetermined different types of noise signals, and computing an optimum gain. The optimum excitation code vector is selected such that error power between a synthesized signal from selected noise signals and an error signal is minimized. A multiplexer combines an index representing the type of the selected codevector and a gain, the spectral parameters, and the adaptive codebook parameters, and transmits the multiplexed data to the receiving side for de-multiplexing.

The above prior art process has a problem that the selection of the optimum excitation codevector from the excitation codebook requires a great deal of computation. This is so because in the methods shown in Literatures 1 and 2 the optimum excitation codevector is selected by making filtering or convolution with respect to each of a plurality of codevectors stored in the codebook, that is, executing the filtering or convolution iteratedly a number of times corresponding to the number of the stored codevectors. With bit number of B and degree of N of a codebook, for instance, the filtering or convolution should be executed $N \times K \times 2^B \times 8000/N$ times per second, where K is the filtering or impulse response length in the filtering or convolution. With B=10, N=40 and K=40, for instance, the necessary computational effort is 81,920,000 times per second, which is very enormous indeed.

To reduce the computational effort that is necessary for the excitation codebook retrieval., various systems have been proposed. Among the proposed systems is an ACELP (Algebraic Code Excited Linear Prediction system, which is described in, for instance, C. Laflamme et al., "16 kbps Wide-Band Speech Coding Technique Based on Algebraic Celp", Proc. ICASSP, pp. 13–16, 1991 (Literature 3). In this system, an excitation signal is represented by a plurality of pulses, and the position of each pulse is represented by a predetermined number of bits that are transmitted. Since the amplitude of each pulse is either "+1.0" or "−1.0", the computational effort for the pulse retrieval can be greatly reduced.

This prior art system described in Literature 3, however, has a problem that the sound quality is not sufficient, although it is possible to obtain great reduction of the computational effort. This is attributable to the fact that each pulse always has the absolute amplitude of "1.0" irrespective of its position and has only either positive or negative in polarity. This means that very coarse amplitude quantization is made, and therefore the sound quality is deteriorated.

Moreover, in the systems described in Literatures 1 to 3, the retrieval of the excitation codebook or pulses is executed under the assumption that the speech signal is multiplied by a fixed gain. Therefore, the performance is deteriorated in the case where the excitation codebook size is reduced by reducing the bit rate or where the number of pulses is small.

SUMMARY OF THE INVENTION

An object of the present invention is therefore to a speech coding system, which can solve the above problems and is less subject to sound quality deterioration with relatively less computational effort even at a low bit rate.

According to an aspect of the present invention, there is provided a speech coder that includes a spectral parameter computer that obtains a plurality of spectral parameters from an input speech signal, and quantizes the spectral parameters that are obtained, and an excitation quantizer that retrieves the positions of M non-zero amplitude pulses that together constitute an excitation with different gains for multiplification of each set for each group of pulses less in number than M. The excitation quantizer includes a codebook for jointly quantizing the amplitudes or polarities of a plurality of pulses.

According to another aspect of the present invention, there is provided a speech coder that includes a spectral parameter computer for obtaining a plurality of spectral parameters from an inputs speech signal, and quantizes the spectral parameters that are obtained, and an excitation quantizer that retrieves positions of M non-zero amplitude pulses that constitute an excitation signal of the input speech signal with a different gain for each group of the pulses less in number than M. In addition, a second excitation quantizer retrieves the positions of a predetermined number of pulses by using the spectral parameters, and the outputs of the first and second excitation quantizers are used to compute distortions of the speech so as to select the less distorted one of the first and second excitation quantizers. The excitation quantizer includes a codebook for jointly quantizing the amplitudes or polarities of a plurality of pulses. The speech coder further includes a mode judging circuit that obtains a feature quantity form the input speech signal, and judges one of a plurality of different modes from the obtained feature quantity and outputting mode data, where the first and second excitation quantizers are used switchedly according to the mode data.

According to a further aspect of the present invention, there is provided a speech coder including a spectral parameter computer that obtains spectral parameters from an input speech signal and quantizes the spectral parameters thus obtained. An impulse response computer computes impulse responses corresponding to the spectral parameters. In addition, a first correlation computer computes correlations of the input signal and the impulse response, and a second correlation computer computes correlations among the impulse responses. A first pulse data computer computes positions of first pulses from the outputs of the first and second correlation computers, a third correlation computer corrects the output of the first correlation computer by using the output of the first pulse data computer, and a second pulse data computer computes positions of second pulses from the outputs of the third and second correlation computers, where the pulse data computation is made by executing the correlation correction and the pulse data computation iteratedly a predetermined number of times.

According to a further aspect of the present invention, there is provided a speech coder including a spectral parameter computer that obtains a plurality of spectral parameters from an input speech signal and quantizes the obtained spectral parameter, and an adaptive codebook that obtains a delay corresponding to a pitch period from the input speech signal, computes a pitch prediction signal, and executes pitch prediction. An excitation quantizer forms an excitation signal of the input speech signal with M non-zero amplitude pulses, obtains a sample position corresponding to a pulse position meeting a predetermined condition with respect to the computed pitch prediction signal, sets a pulse position retrieval range on the basis of a position obtained by shifting the sample position that is obtained by a predetermined number of samples, retrieves a best position in the pulse position retrieval range thus set, and outputs data of the retrieved best position.

According to still a further aspect of the present invention, there is provided a speech coder including a spectral parameter computer that obtains a plurality of spectral parameters from an input speech signal and quantizes the obtained spectral parameters, and an adaptive codebook that obtains a delay corresponding to a pitch period from the input speech signal, computes a pitch prediction signal, and executes pitch predication. An excitation quantizer forms an excitation signal of the input speech signal with M non-zero amplitude pulses, obtains a sample position meeting a predetermined condition with respect to the pitch prediction signal in a time interval equal to the pitch period from the forefront of a frame, sets a pulse position retrieval range for retrieving a pulse candidates position on the basis of a position obtained by shifting the obtained sample position by a predetermined numbers of samples, retrieves a best position in the pulse sample position retrieval range thus set, and outputs data of the retrieved best position.

According to still another aspect of the present invention, there is provided a speech coder including a spectral parameter computer for obtaining a plurality of spectral parameters from an input speech signal and quantizes the obtained spectral parameters, and an adaptive codebook that obtains a delay corresponding to a pitch period from the input speech signal, computes a pitch prediction signal, and executes pitch prediction. An excitation quantizer forms an excitation signal of the input speech signal with M non-amplitude pulses, obtains a sample position corresponding to a pulse position meeting a predetermined condition with respect to the computed pitch prediction signal in a time interval equal to the pitch period from the forefront of a frame, sets pulse position candidates through shifting the obtained sample position by the pitch period on the basis of the position shifted by a predetermined numbers of samples from the sample position, retrieves the position candidates for a best position, and outputs data of the retrieved best position.

The excitation quantizer includes a codebook for jointly quantizing the amplitudes or polarities of a plurality of pulses.

According to another aspect of the present invention, there is provided a speech coder including a spectral parameter computer that obtains a plurality of spectral parameters from an input speech signal and quantizes the obtained spectral parameters, and an adaptive codebook that obtains a delay corresponding to a pitch period from the input speech signal, computes a pitch prediction signal, and executes pitch prediction. In addition, an excitation quantizer forms an excitation signal of the input speech signal with M non-zero amplitude pulses, obtains a sample position meeting a predetermined condition with respect to the computed pitch prediction signal, sets a plurality of pulse position retrieval ranges on the basis of positions obtained by shifting the obtained sample position by corresponding shift extents, makes retrieval of the pulse position retrieval ranges to select a best combination of a shift extent and a pulse position, and outputs data of the selected best combination.

According to a further aspect of the present invention, there is provided a speech coder that includes a spectral parameter computer that obtains a plurality of spectral parameters from an input speech and quantizes the obtained spectral parameters, and an adaptive codebook that obtains a delay corresponding to a pitch period from the input speech signal, computes a pitch prediction signal, and executes pitch prediction. In addition, an excitation quantizer forms an excitation signal of the input speech signal with M non-zero amplitude pulses, obtains a sample pulse position meeting a predetermined condition with respect to the computed pitch prediction signal in a time interval equal to the pitch period from the forefront of a frame, sets a plurality of pulse position retrieval ranges on the basis of positions obtained by shifting the obtained sample position by corresponding shift extents, makes retrieval of the pulse position retrieval ranges to select a best combination of a shift extent and a pulse position, and outputs data of the selected best combination.

According to still a further aspect of the present invention, there is provided a speech coder including a spectral parameter computer that obtains a plurality of spectral parameters from an input speech signal and quantizes the obtained spectral parameters, and an adaptive codebook that obtains a delay corresponding to a pitch period from the input speech signal, computes a pitch prediction signal, and executes pitch prediction. Also, an excitation quantizer forms an excitation signal of the input speech signal with M non-zero amplitude pulses, obtains a sample pulse position meeting a predetermined condition with respect to the computed pitch prediction signal in a time interval equal to the pitch period from the forefront of a frame, sets pulse position candidates through shifting the obtained sample position by the pitch period on the basis of the position shifted by predetermined numbers of samples from the sample position, retrieves the position candidates for a best position, and outputs data of the retrieved best position.

The excitation quantizer includes a codebook for jointly quantizing the amplitudes or polarities of a plurality of pulses.

According to still a further aspect of the present invention, there is provided a speech coder that includes a spectral parameter computer that obtains a plurality of spectral parameters from an input speech signal and quantizes the obtained spectral parameters. Also, a mode judging unit extracts a characteristic amount from the input speech signal, judges a plurality of modes from the extracted feature quantity, and outputs mode data, and an adaptive codebook obtains a delay corresponding to a pitch period from the input speech signal, computes a pitch prediction signal, and makes pitch prediction. Furthermore, an excitation quantizer forms an excitation signal of the input speech signal with M non-zero amplitude signals, obtains a sample position meeting a predetermined condition with respect to the pitch prediction signal when the mode data represents a predetermined mode, sets a pulse position retrieval range on the basis of the obtained sample position, retrieves a best position in the pulse position retrieval range, and outputs data of the retrieved best position.

The feature quantity is an average pitch prediction gain. The mode judging unit judges the modes on the basis of comparison of the average pitch prediction gain with a plurality of threshold values.

According to still a further aspect of the present invention, there is provided a speech coder that includes a spectral parameter computer that obtains a plurality of spectral parameters from an input speech signal and quantizes the obtained spectral parameters, and an adaptive codebook that obtains a delay corresponding to a pitch period from the input speech signal, computes a pitch prediction signal, and executes pitch prediction. In addition, an excitation quantizer obtains a position meeting a predetermined condition with respect to the pitch prediction signal computed in the adaptive codebook means, sets a plurality of pulse position retrieval ranges for respective pulses constituting an excitation signal, and retrieves the pulse position retrieval ranges for the best positions of the pulses.

Other objects and features will be clarified from the following description with reference to attached drawings.

PREFERRED EMBODIMENTS OF THE INVENTION

Embodiments of the present invention will now be described with reference to the drawings.

Figure 1:
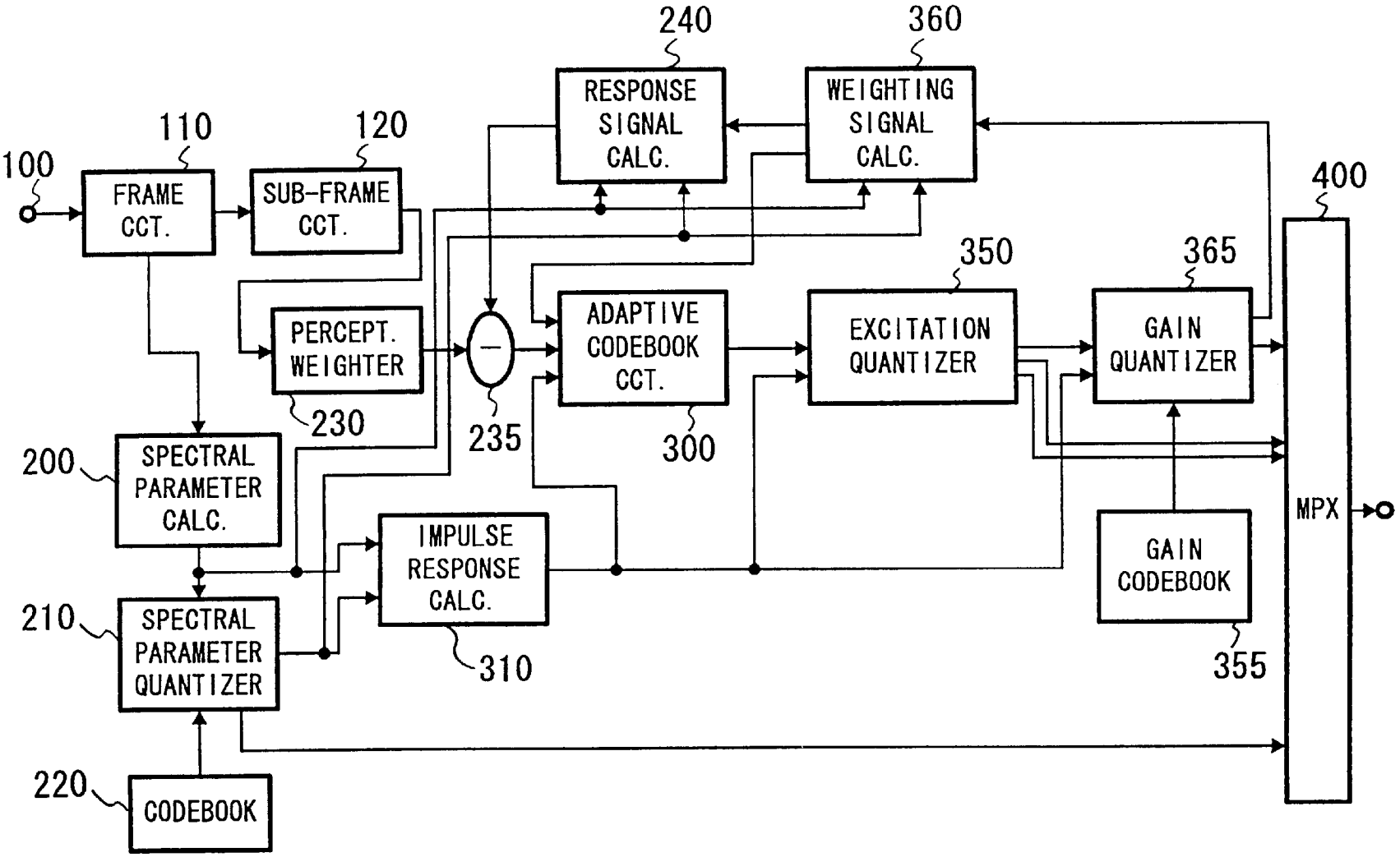
FIG. 1 is a block diagram showing a first embodiment of the speech coder according to the present invention.

FIG. 1 is a block diagram showing a first embodiment of the speech coder according to the present invention.

Referring to the figure, a frame circuit 110 splits a speech signal inputted from an input terminal 100 into frames (of 10 ms, for instance), and a sub-frame circuit 120 further splits each frame of speech signal into a plurality of shorter sub-frames (of 5 ms, for instance).

A spectral parameter computer 200 computes a spectral parameters of a predetermined order P (for instance, P=10) by cutting the speech signal with a window longer than the sub-frame length (for instance 24 ms) for each with respect to at least one sub-frame of speech signal. The spectral parameters may be calculated in a well-known process of LPC analysis, Burg analysis, etc. In the instant case, it is assumed that the Burg analysis is used. The Burg analysis is detailed in Nakamizo, "Signal Analysis and System Identification", published by Corona Co., Ltd., 1988, pp. 82–87 (Literature 4), and not described in the specification.

The spectral parameter computer 200 also converts linear prediction parameters $\alpha_i$ (i=1, 10) which have been obtained by the Burg process into LSP parameters suited for quantization or interpolation. The conversion of the linear prediction parameters into the LSP parameters is described in Sugamura et al., "Speech Compression by Linear Spectrum Pair (LSP) Speech Analysis Synthesis System", J64-A, 1981, pp. 599–606 (Literature 5). For example, the spectral parameter computer 200 converts the linear prediction parameters obtained in the 2-nd sub-frame by the Brug process into LSP parameters, obtains the 1-st sub-frame LSP parameters by linear interpolation, inversely converts the 1-st sub-frame LSP parameters thus obtained into linear prediction parameters, and outputs the linear prediction parameters $\alpha_{il}$ (i=1, . . . , 10, 1=1, . . . , 2) of the 1-st and 2-nd sub-frames to a perceptual weighter 230, while outputting the 2-nd sub-frame LSP parameters to a spectral parameter quantizer 210.

The spectral parameter quantizer 210 efficiently quantizes LSP parameters of predetermined sub-frames by using a codebook 220, and outputs quantized LSP parameters which minimizes a distortion given as:

$$D_j = \sum_{i}^{P} W(i)[LSP(i) - QLSP(i)_j]^2 \tag{1}$$

where LSP(i) is i-th sub-frame LSP parameters before the quantization, $QLSP(i)_j$ is a j-th sub-frame codevector stored in the codebook 220, and W(i) is a weighting coefficient.

In the following description, it is assumed that the vector quantization is used as the quantization and the 2-nd sub-frame LSP parameters is quantized. The LSP parameters may be vector quantized by any well-known process. Specific examples of the process are disclosed in Japanese Laid-Open Patent Publication No. 4-171500 (Japanese Patent Publication No. 2-297600) (Literature 6), Japanese Laid-Open Patent Publication No. 4-363000 (Japanese Patent Application No. 3-261925) (Literature 7), Japanese Laid-Open Patent Publication No. 5-6199 (Japanese Patent Application No. 3-155049 (Literature 8), and T. Nomura et al., "LSP Coding Using VQ-SVQ with Interpolation in 4.075 kbps M-LCELP Speech Coder", Proc. Mobile Multimedia Communications", B.2.5, 1993 (Literature 9), these processes being not described in the specification.

The spectral parameter quantizer 210 also restores the 1-st sub-frame LSP parameters from the 2-nd sub-frame quantized LSP parameters. In the instant case, the 1-st sub-frame LSP parameters are restored by linear interpolation between the 2-nd sub-frame quantized LSP parameters of the present frame and the 2-nd sub-frame quantized LSP parameters of the immediately preceding frame. Here, the 1-st sub-frame LSP parameters are restored by the linear interpolation after selecting a codevector which minimizes the error power between the non-quantized and quantized LSP parameters.

The spectral parameter quantizer 210 converts the restored 1-st sub-frame LSP parameters and the 2-nd sub-frame quantized LSP parameters into the linear prediction parameters $\alpha_{il}$ (i=1, . . . , 10, l=1, . . . , 2) for each sub-frame, and outputs the result of the conversion to an impulse response computer 310, while outputting an index representing the 2-nd sub-frame quantized LSP parameters codevector to a mutiplexer 400.

The perceptual weighter 230 receives each sub-frame non-quantized linear prediction parameters $\alpha_i$ (i=1, . . . , P) from the spectral parameter computer 200, perceptual-weights the sub-frame speech signal according to Literature 1, and outputs a perceptually weighted signal thus obtained.

A response signal computer 240 receives each sub-frame linear prediction parameters $\alpha_i$ and also each sub-frame linear prediction coefficient $\alpha_i'$, having been restored by quantization and interpolation, from the spectral parameter computer 200 and the spectral parameter quantizer 210, computes a response signal corresponding to an input signal of d(n)=0 for one sub-frame by using stored filter memory data, and outputs the computed response signal to a subtractor 235. The response signal $x_z(n)$ is expressed as:

$$x_z(n) = d(n) - \sum_{i=1}^{P} \alpha_i d(n-i) + \sum_{i=1}^{P} \alpha_i \gamma^i y(n-i) + \sum_{i=1}^{P} \alpha_i' \gamma^i x_z(n-i) \tag{2}$$

When $n-1 \leqq 0$, $$y(n-i)=p(N+(n-i)) \tag{3}$$

$$x_z(n-i)=s_w(N+(n-i)) \tag{4}$$

where N is the sub-frame length, γ is a weighting coefficient for controlling the order of the perceptually weighting and the same in value as shown in equation (6) given below, $s_w(n)$ is the output signal of the weighting signal computer 230, and p(n) is a filter output signal in the divisor of the first term of the right side of equation (6).

The subtractor 235 subtracts the response signal from the heating sense weighted signal for one sub-frame, and outputs the difference $x_w'(n)$ to an adaptive codebook circuit 300.

$$x'_w(n)=x_w(n)-x_z(n) \tag{5}$$

The impulse response calculator 310 calculates the impulse response $h_w(n)$ of the perceptually weighting filter executes the following z transform:

$$H_w(z) = \frac{1 - \sum_{i=1}^{P} \alpha_i z^{-i}}{1 - \sum_{i=1}^{P} \alpha_i \gamma^i z^{-i}} \frac{1}{1 - \sum_{i=1.}^{P} \alpha_i' \gamma^i z^{-i}} \tag{6}$$

for a predetermined number L of points, and outputs the result to the adaptive codebook circuit 300 and also to an excitation quantizer 350.

The adaptive codebook circuit 300 receives the past excitation signal v(n) from the weighting signal calculator 360, the output signal $x'_w(n)$ from the subtractor 235 and the perceptually weighted impulse response $k_w(n)$ from the impulse response calculator 310, determines a delay T corresponding to the pitch such as to minimize the distortion:

$$D_T = \sum_{n=0}^{N-1} x_w'^2(n) - \left[\sum_{n=0}^{N-1} x_w'(n) y_w(n-T)\right]^2 \Big/ \left[\sum_{n=0}^{N-1} y_w^2(n-T)\right] \tag{7}$$

$$y_w(n-T)=v(n-T)*h_w(n) \tag{8}$$

represents a pitch prediction signal, and the symbol * represents convolution. It also obtains the gain β as:

$$\beta = \sum_{n=0}^{N-1} x_w'(n) y_w(n-T) \Big/ \sum_{n=0}^{N-1} y_w^2(n-T) \tag{9}$$

In order to improve the delay extraction accuracy for women's speeches and children's speeches, the delay may be obtained as decimal sample values rather than integer samples. For a specific process, P. Kroon et. al, "Pitch predictors with high temporal resolution", Proc. ICASSP, 1990, pp. 661–664 (Literature 10), for instance, may be referred to.

The adaptive codebook circuit 300 makes the pitch prediction as:

$$z_w(n)=x'_w(n)-\beta v(n-T)*h_w(n) \tag{10}$$

and outputs the prediction error signal $z_w(n)$ to the excitation quantizer 350.

An excitation quantizer 350 provides data of M pulses. The operation in the excitation quantizer 350 is shown in the flow chart of FIG. 2.

The operation comprises two stages, one dealing with some of a plurality of pulses, the other dealing with the remaining pulses. In two stages different gains for multiplification are set for pulse position retrieval.

The excitation signal c(n) is expressed as:

$$c(n) = G_1 \sum_{k=1}^{M_1} \text{sign}(k)\delta(n-m_k) + G_2 \sum_{i=1}^{M_2} \text{sign}(i)\delta(n-m_i) \tag{11}$$

where $M_1$ is the number of first stage pulses, $M_2$ is the number of second stage pulses, sign(k) is the polarity of a k-th pulse, $G_1$ is the gain of the first stage pulses, $G_2$ is the gain of the second stage pulses, and $M_1+M_2=M$.

Figure 2:
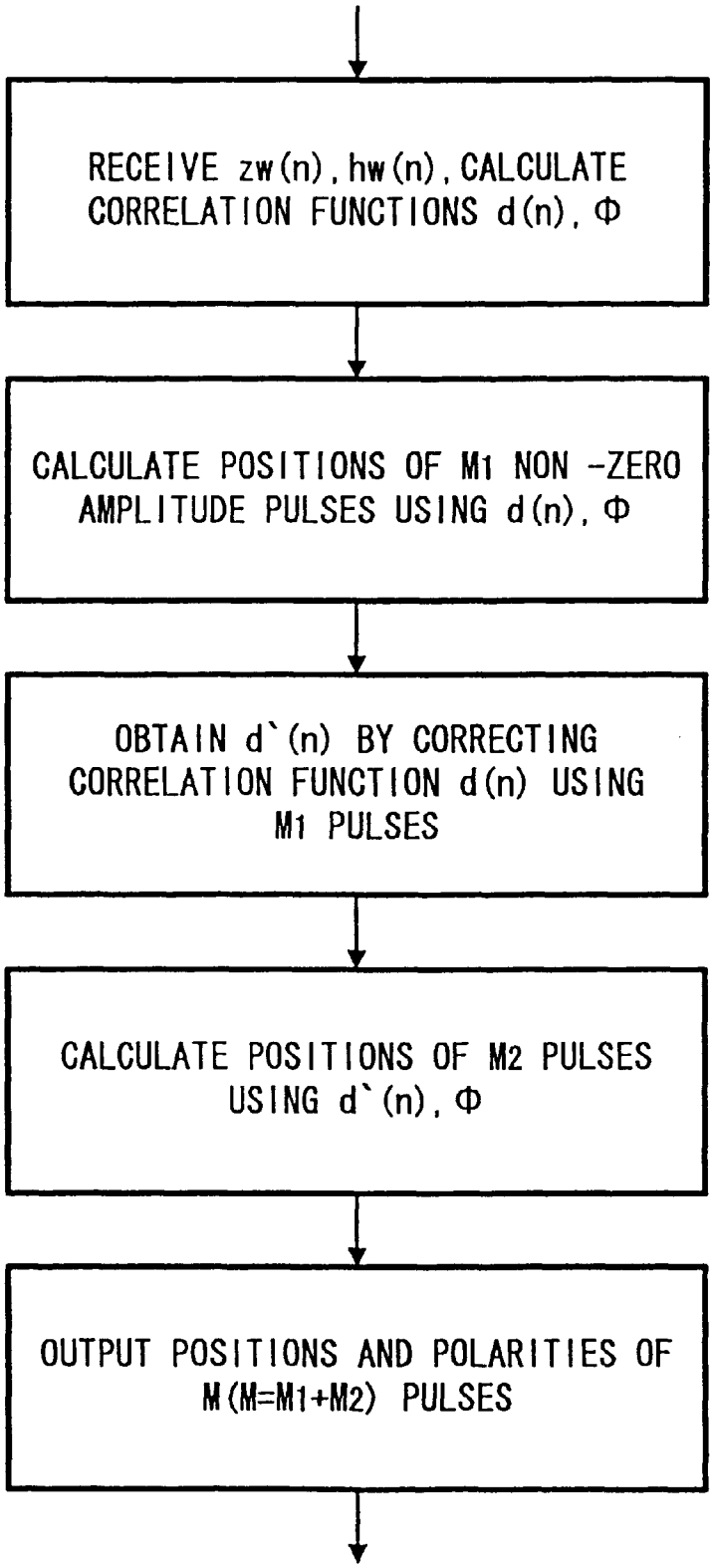
FIG. 2 shows a flow chart for explaining the operation in the excitation quantizer 350.

Referring to FIG. 2, in a first step $z_w(n)$ and $h_w(n)$ are inputted, and a first and a second correlation function d(n) and $\phi$ are calculated as $$d(n) = \sum_{i=n}^{N-1} z(i)h_w(i-n),\ n = 0, \ldots, N-1 \tag{12}$$

$$\phi(p, q) = \sum_{n=\max(p,q)}^{N-1} h_w(n-p)h_w(n-q),\ p, q = 0, \ldots, N-1 \tag{13}$$

In a subsequent step, the positions of the $M_1$ ($M_1 \leqq M$) non-zero amplitude pulses (or first pulses) are computed by using the above two correlation functions. To this end, predetermined positions as candidates are retrieved for an optimal position of each pulse as according to Literature 3.

In FIG. 2, examples of candidates for each pulse position where sub-frame length N=40 and number of pulses $M_1$=5 are as shown in the following table 1:

| | | | | | | | | |
|---|---|---|---|---|---|---|---|---|
| FIRST PULSE | 0 | 5 | 10 | 15 | 20 | 25 | 30 | 35 |
| SECOND PULSE | 1 | 6 | 11 | 16 | 21 | 26 | 31 | 36 |
| THIRD PULSE | 2 | 7 | 12 | 17 | 22 | 27 | 32 | 37 |
| FOURTH PULSE | 3 | 8 | 13 | 18 | 23 | 28 | 33 | 38 |
| FIFTH PULSE | 4 | 9 | 14 | 19 | 24 | 29 | 34 | 39 |

For each pulse, each position candidate is checked to select an optimal position, which maximizes an equation:

$$D = \frac{C_k^2}{E_k} \quad \text{where} \tag{14}$$

$$C_k = \sum_{k=1}^{M_1} \text{sign}(k)d(m_k) \tag{15}$$

$$E = \sum_{k=1}^{M_1} \text{sign}(k)^2\phi(m_k, m_k) + 2\sum_{k=1}^{M-1}\sum_{i=k+1}^{M_1} sgn(k)sgn(i)\phi(m_k, m_i) \tag{16}$$

$M_1$ pulse positions are outputted.

Then, using the computed positions of $M_1$ pulses the correlation function d(n) is corrected with the amplitude as the polarity as:

$$d'(n) = d(n) - \sum_{k=1}^{M_1} \text{sign}(k)\phi(m_n, m_k), \tag{17}$$

$$n=0, \ldots, N-1 \tag{18}$$

Next, using d'(n) and $\phi$ the positions of the M2 pulses are computed. In this step, d'(n) may be substituted for d(n) in equation (15), and the number of pulses may be set to $M_2$.

The polarities and positions of a total of M pulses are thus obtained and outputted to a gain quantizer 365. The pulse positions are each quantized with a predetermined number of bits, and indexes representing the pulse positions are outputted to the multiplexer 400. The pulse polarities are also outputted to the multiplexer 400.

The gain quantizer 365 reads out the gain codevectors from a gain codebook 355, selects a gain codevector which minimizes the following equation, and finally selects a combination of an amplitude codevector and a gain codevector which minimizes the distortion.

It is now assumed that three different excitation gains $G_1$ to $G_3$ represented by adaptive codebook gains and pulses are vector quantized at a time.

$$D_t = \sum_{n=0}^{N-1}\left[x_w(n) - \beta_t' v(n-T) * h_w(n) - G_{1t}'\sum_{ki=1}^{M_1} \text{sign}(k)h_w(n-m_k) - G_{2t}'\sum_{i=1}^{M_t} \text{sign}(i)h_w(n-m_i)\right]^2 \tag{19}$$

Denoted $\beta_t'$, $G_{1t}'$ and $G_{2t}'$ are t-th elements of three-dimensional gain codevectors stored in the gain codebook 355. The gain quantizer 365 selects a gain codevector which minimizes the distortion $D_t$ by executing the above computation with each gain codevector, and outputs the index of the selected gain codevector to the multiplexer 400.

The weighting signal computer 360 receives each index, reads out the corresponding codevector, and obtains a drive excitation signal V(n) given as:

$$v(n) = \beta_t' v(n-T) + G_{1t}'\sum_{k=1}^{M_1} \text{sign}(k)\delta(n-m_k) + G_{2t}'\sum_{i=1}^{M_2} \text{sign}(i)\delta(n-m_i) \tag{20}$$

V(n) being outputted to the adaptive codebook circuit 300.

The weighting signal computer 360 then computes the response signal $s_w(n)$ for each sub-frame from the output parameters of the spectral parameter computer 200 and the spectral parameter quantizer 210 by using the following equation, and outputs the computed response signal to the response signal computer 240.

$$s_w(n) = v(n) - \sum_{i=1}^{P} a_i v(n-i) + \sum_{i=1}^{P} a_i\gamma^i p(n-i) + \sum_{i=1}^{P} a_i'\gamma^i s_w(n-i) \tag{21}$$

Figure 3:
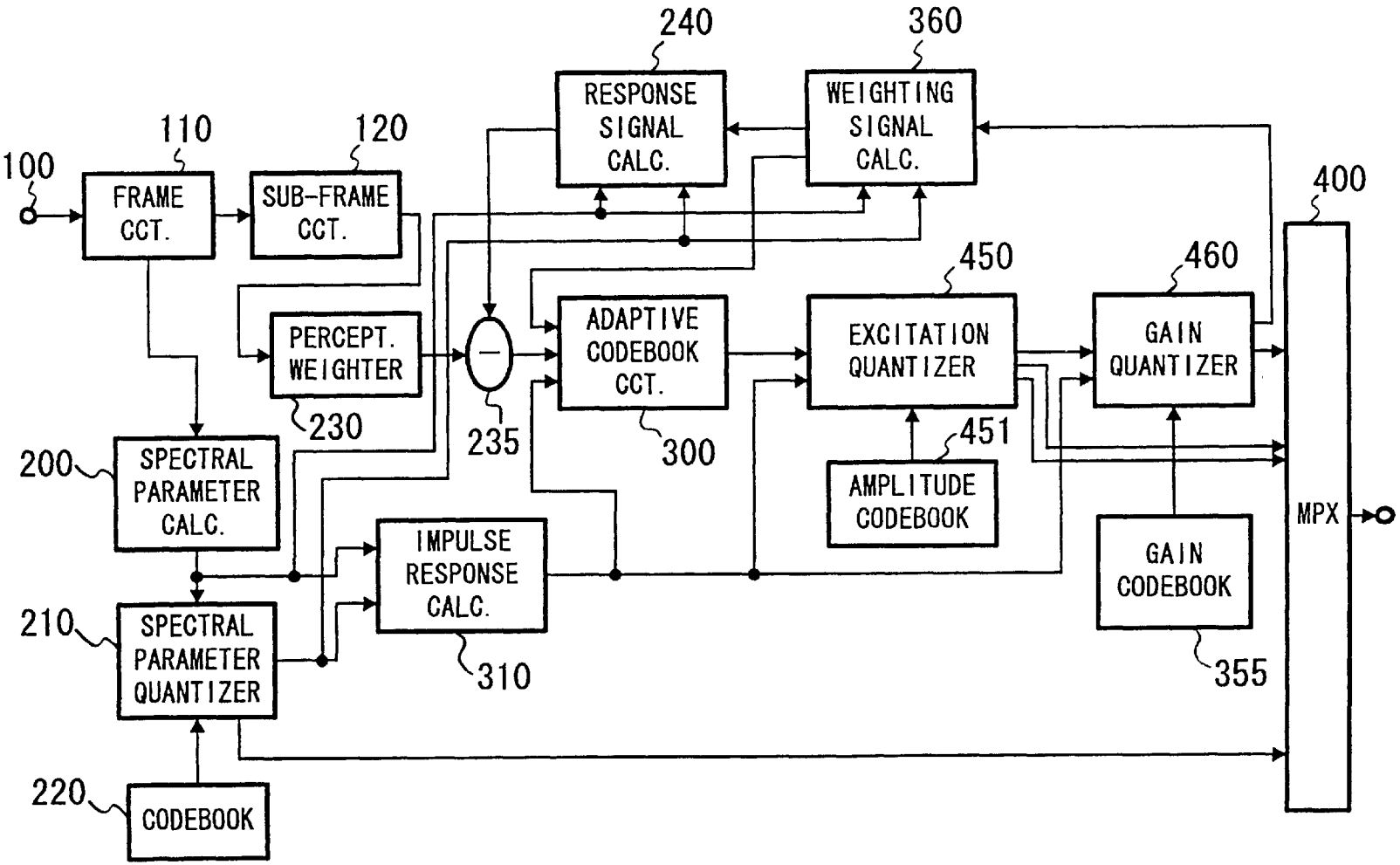
FIG. 3 is a blcok diagram showing a second embodiment of the present invention.

FIG. 3 is a block diagram showing a second embodiment of the present invention. This embodiment comprises an excitation quantizer 450, which is different in operation form that in the embodiment shown in FIG. 1. Specifically, the sound source quantizer 450 quantizes pulse amplitudes by using an amplitude codebook 451.

In the excitation quantizer 450, after the positions of the $M_1$ pulses have been obtained, Q ($Q \geqq 1$) amplitude codevector candidates are outputted for maximizing an equation:

$$C_j^2 / E_j \tag{22}$$

$$C_j = \sum_{k=1}^{M_1} g_{kj}' d(m_k) \tag{23}$$

$$E_j = \sum_{k=1}^{M_1} g_{kj}'^2\phi(m_k, m_k) + 2\sum_{k=1}^{M_1-1}\sum_{i=k+1}^{M_1} g_{kj}'g_{ij}'\phi(m_k, m_i) \tag{24}$$

were $g_{ki}'$ is an j-th amplitude codevector of a k-th pulse.

Then, the correlation function is corrected with respect to each of the selected Q amplitude codevectors using an equation:

$$d'(n) = d(n) - \sum_{k=1}^{M_1} g_{kj}'\phi(m_n, m_k) \tag{25}$$

Then, for each corrected correlation function d'(n) the amplitude codevectors in the amplitude codebook 451 are retrieved with respect to the remaining $M_2$ pulses, and a pulse which maximizes the following equation is selected.

$$C_i^2 / E_i \tag{26}$$

$$C_i = \sum_{k=1}^{M_2} g_{ki}'d'(m_k) \tag{27}$$

$$E_i = \sum_{k=1}^{M_2} g_{ki}'^2\phi(m_k, m_k) + 2\sum_{k=1}^{M_2-1}\sum_{l=k+1}^{M_2} g_{li}'g_{li}'\phi(m_k, m_i) \tag{28}$$

The above process is executed iteratedly for the Q corrected functions d'(n), and a combination which maximizes the accumulated value given as:

$$D=C_j^2/E_j+C_i^2/E_i \tag{29}$$

is selected.

The excitation quantizer 450 outputs the index representing the selected amplitude codevector to the mutiplexer 400. It also outputs position data and amplitude codevector data to a gain quantizer 460.

The gain quantizer 460 selects a gain codevector which minimizes the following equation from the gain codebook 355.

$$D_t = \sum_{n=0}^{N-1}\left[x_w(n) - \beta_t'v(n-T) * h_w(n) - G_{1t}'\sum_{ki=1}^{M_1} g_k'h_w(n-m_k) - G_{2t}'\sum_{i=1}^{M_2} g_i'h_w(n-m_i)\right]^2 \tag{30}$$

While in this embodiment the amplitude codebook 451 is used, it is possible to use, instead, a polarity codebook showing the pulse polarities.

Figure 4:
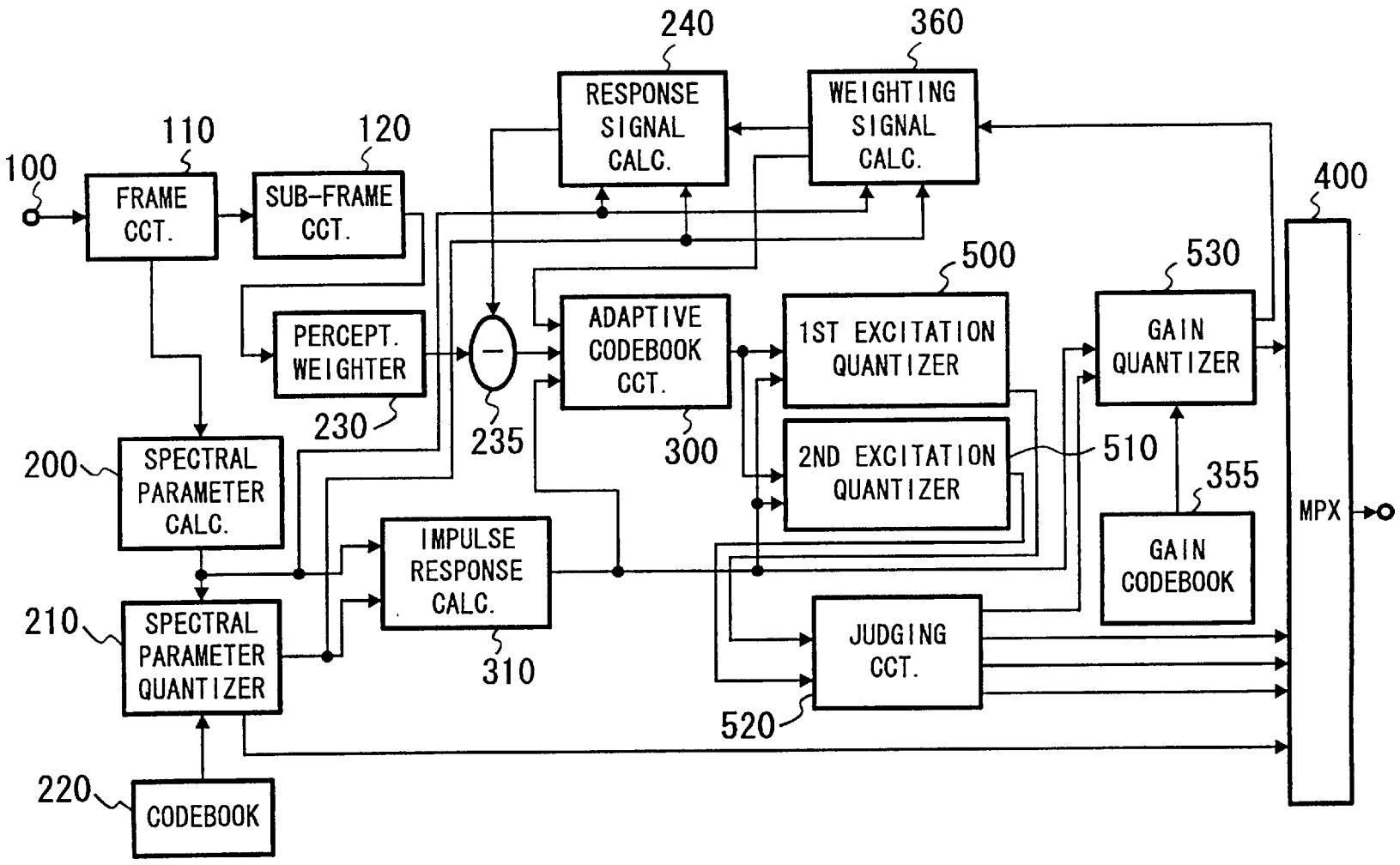
FIG. 4 is a block diagram showing a third embodiment of the present invention.

FIG. 4 is a block diagram showing a third embodiment of the present invention.

This embodiment uses a first and a second excitation quantizer 500 and 510. In the first excitation quantizer 500, like the above excitation quantizer 350 shown in FIG. 1, the operation comprises two stages, one dealing with some of the pulses and the other dealing with the remaining pulses, and different gains for multiplification are set for the pulse position retrieval. The two stages, in which the operation is executed, is by no means limitative, and it is possible to provide any number of stages. The pulse position retrieval method is the same as in the excitation quantizer 350 shown in FIG. 1. The excitation signal $c_1(n)$ in this case is given as:

$$c_1(n) = G_1\sum_{k=1}^{M_1}\text{sign}(k)\delta(n-m_k) + G_2\sum_{i=1}^{M_2}\text{sign}(i)\delta(n-m_i) \tag{31}$$

After the pulse position retrieval, a distortion $D_1$ due to a first excitation is computed as:

$$D_1 = \sum_{n=0}^{N-1}([x_w(n) - c_1(n) * h_w(n)])^2 \tag{32}$$

It is possible to replace the above equation with an equation:

$$D_1 = \sum_{n=0}^{N-1} x_w^2(n) - [C_j^2/E_j + C_i^2/E_i] \tag{33}$$

As $C_j$, $C_i$, $E_j$ and $E_i$, values after the pulse position retrieval are used.

In the second excitation quantizer 510, the operation comprises a single stage, and a single gain for multiplification is set for all the M ($M>(M_1+M_2)$) pulses. A second excitation signal $c_2(n)$ is given as:

$$c_2(n) = G\sum_{k=1}^{M}\text{sign}(k)\delta(n-m_k) \tag{34}$$

where G is the gain for all the M pulses.

A distortion $D_2$ due to the second excitation is computed as:

$$D_2 = \sum_{n=0}^{N-1}([x_w(n) - c_2(n) * h_w(n)])^2 \tag{35}$$

or as:

$$D_2 = \sum_{n=0}^{N-1} x_w^2(n) - C_l^2/E_l \tag{36}$$

As $C_1$ and $E_1$ are used values after the pulse position retrieval in the second excitation quantizer 510.

A judging circuit 520 compares the first and second excitation signals $c_1(n)$ and $c_2(n)$ and the distortions $D_1$ and $D_2$ due thereto, and outputs the less distortion excitation signal to a gain quantizer 530. The judging circuit 520 also outputs a judgment code to the gain quantizer 530 and also to the multiplexer 400, and outputs codes representing the positions and polarities of the less distortion excitation signal pulses to the multiplexer 400.

The gain quantizer 530, receiving the judgment code, executes the same operation as in the above gain quantizer 365 shown in FIG. 1 when the first excitation signal is used. When the second excitation is used, it reads out two-dimensional gain codevectors from the gain codevector 540, and retrieves for a codevector which minimizes an equation:

$$D_{2t} = \sum_{n=0}^{N-1}\left[x_w(n) - \beta_t'v(n-T) * h_w(n) - G_t'\sum_{ki=1}^{M}\text{sign}(k)h_w(n-m_k)\right]^2 \tag{37}$$

It outputs the index of the selected gain codevector to the multiplexer 400.

Figure 5:
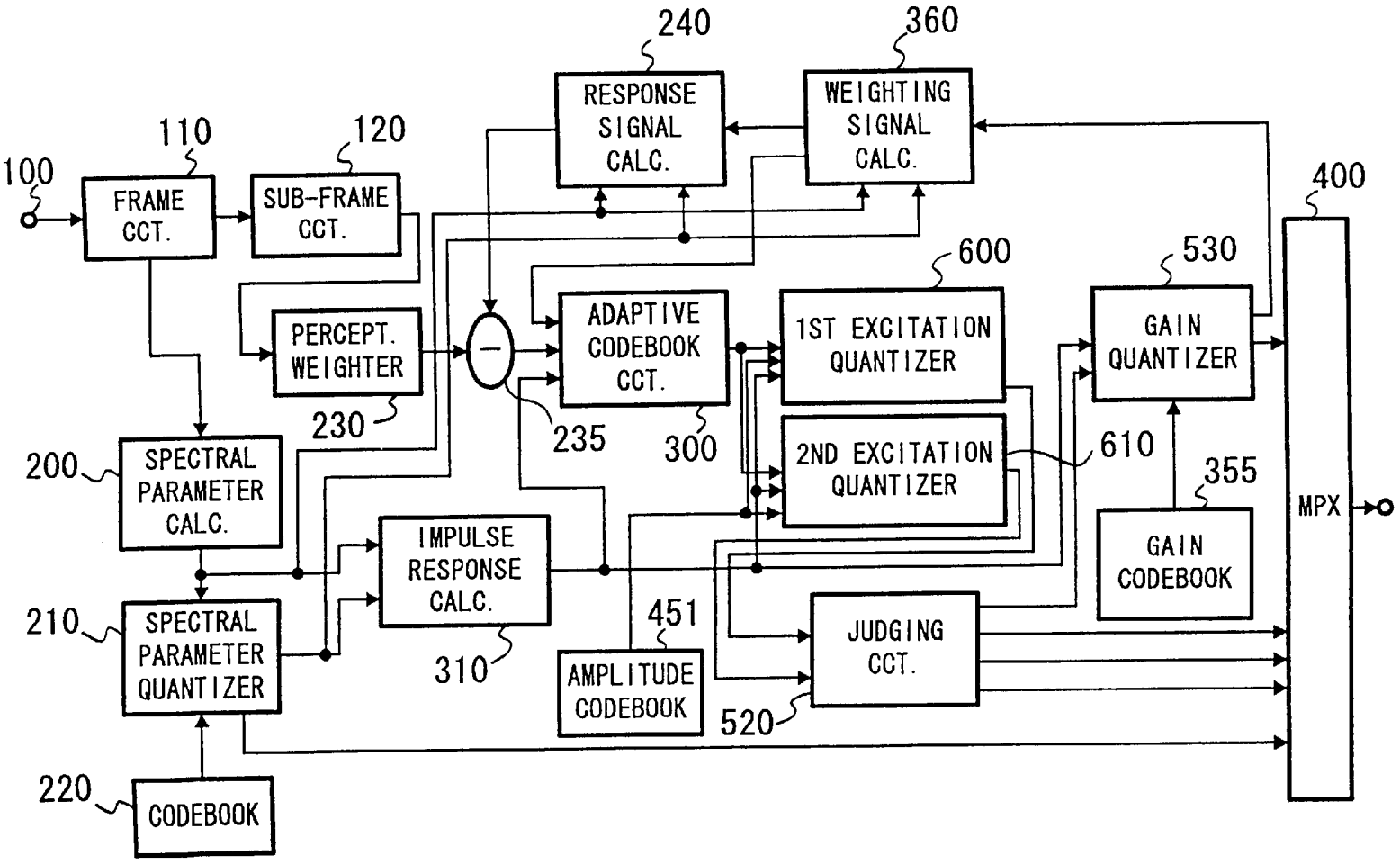
FIG. 5 is a block diagram showing a fourth embodiment of the present invention.

FIG. 5 is a block diagram showing a fourth embodiment of the present invention. This embodiment uses a first and a second excitation quantizer 600 and 610, which different operations from those in the case of the embodiment shown in FIG. 4.

The first excitation quantizer 600, like the excitation quantizer 450 shown in FIG. 3, quantizes the pulse amplitudes by using the amplitude codebook 451.

After the positions of the $M_1$ pulses have been determined, it selects Q (Q≧1) amplitude codevector candidates for maximizing an equation:

$$C_j^2 / E_j \tag{38}$$

$$C_j = \sum_{k=1}^{M_1} g'_{kj} d(m_k) \tag{39}$$

$$E_j = \sum_{k=1}^{M_1} g'^2_{kj} \phi(m_k, m_k) + 2 \sum_{k=1}^{M_1-1} \sum_{i=k+1}^{M_1} g'_{kj} g'_{ij} \phi(m_k, m_i) \tag{40}$$

where $g_{kj}'$ is a j-th amplitude codevector of a k-th pulse according to the following equation.

$$d'(n) = d(n) - \sum_{k=1}^{M_1} g'_{kj} \phi(m_n, m_k) \tag{41}$$

Then, with respect to each of the Q corrected correlation functions d'(n) it retrieves the amplitude codevectors in the amplitude codevector 451 for the remaining $M_2$ pulses, and selects an amplitude codevector which maximizes an equation:

$$C_i^2/E_i \tag{42}$$

where $$C_i = \sum_{k=1}^{M_2} g'_{ki} d'(m_k) \tag{43}$$

$$E_i = \sum_{k=1}^{M_2} g'^2_{ki} \phi(m_k, m_k) + 2 \sum_{k=1}^{M_2-1} \sum_{l=k+1}^{M_2} g'_{li} g'_{li} \phi(m_k, m_i) \tag{44}$$

It executes above process iteratedly for the Q corrected correlation functions d'(n) to select a combination which maximizes an accumulated value given as:

$$D = C_j^2/E_j + C_i^2/E_i \tag{45}$$

It also obtains the first excitation signal given as:

$$c'_1(n) = G_1 \sum_{k=1}^{M_1} g'_k \delta(n - m_k) + G_2 \sum_{i=1}^{M_2} g'_i \delta(n - m_i) \tag{46}$$

It further computes the distortion $D_1$ due to the first excitation using an equation:

$$D'_1 = \sum_{n=0}^{N-1} ([x_w(n) - c'_1(n) * h_w(n)])^2 \tag{47}$$

and outputs the distortion $D_1$ to the judging circuit 520.

The second excitation quantizer 610 retrieves for an amplitude codevector which maximizes an equation:

$$C_l^2/E_l \tag{48}$$

where $$C_l = \sum_{k=1}^{M} g'_{kl} d(m_k) \tag{49}$$

$$E_l = \sum_{k=1}^{M} g'^2_{kl} \phi(m_k, m_k) + 2 \sum_{k=1}^{M-1} \sum_{i=k+1}^{M} g'_{kl} g'_{il} \phi(m_k, m_i) \tag{50}$$

It also obtains the second excitation signal given as:

$$c'_2(n) = G_1 \sum_{k=1}^{M} g'_k \delta(n - m_k) \tag{51}$$

It further computes the distortion $D_2$ due to the second excitation signal using an equation:

$$D'_2 = \sum_{n=0}^{N-1} ([x_w(n) - c'_2(n) * h_w(n)])^2 \tag{52}$$

and outputs the distortion D2 to the judging circuit 520.

Alternatively, the distortion $D_2$ may be obtained as:

$$D'_2 = \sum_{n=0}^{N-1} x_w^2(n) - C_l^2 / E_l \tag{53}$$

$C_1$ and $E_1$ are correlation values after the second excitation signal pulse positions have been determined.

The judging circuit 520 compares the first and second excitation signals $c_1'(n)$ and $c_2'(n)$ and also compares the distortions $D_1'$ and $D_2'$ due thereto, and outputs the less distortion excitation signal to the gain quantizer 530, while outputting a judgment code to the gain quantizer 530 and the multiplexer 400.

Figure 6:
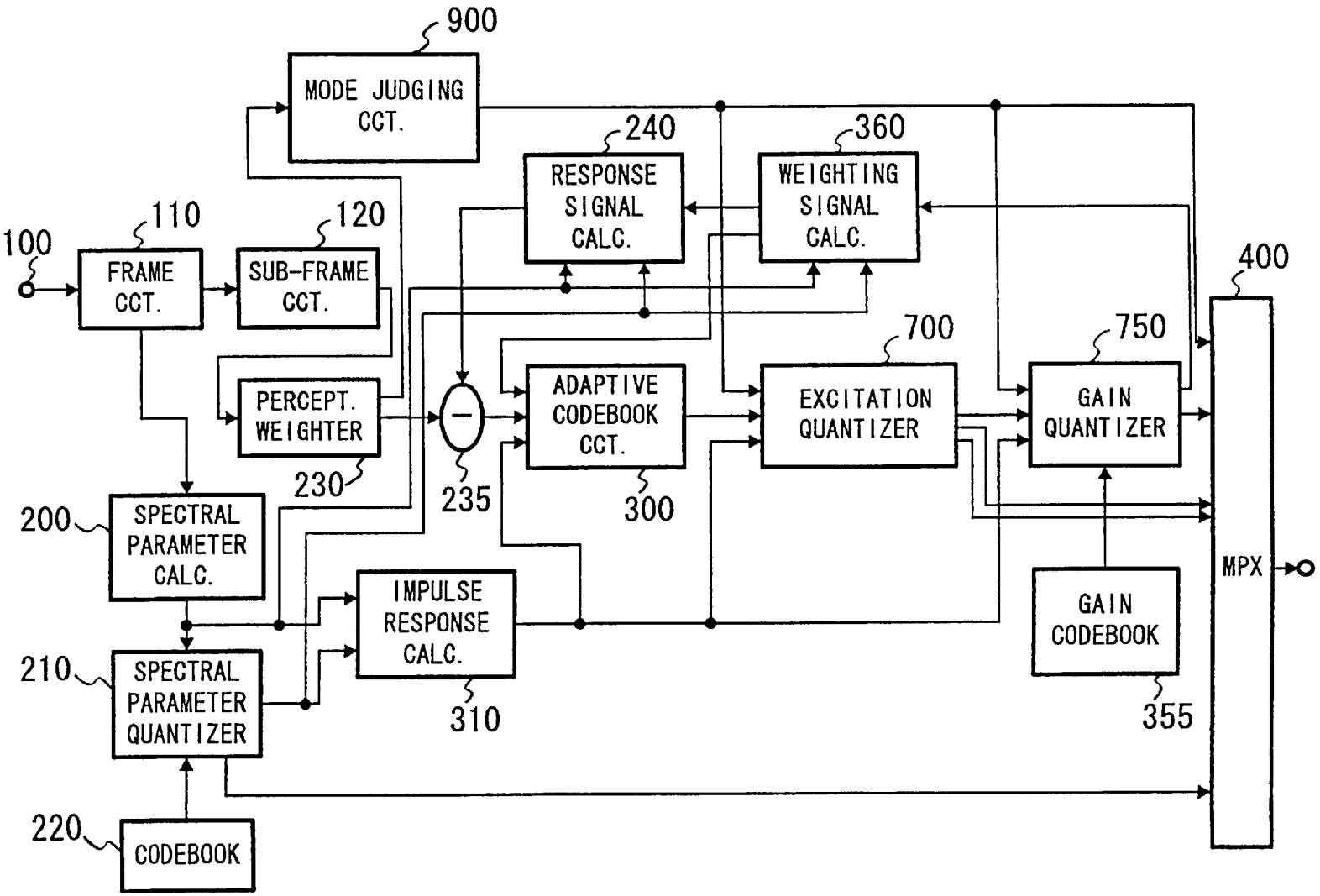
FIG. 6 is a block diagram showing a fifth embodiment of the present invention.

FIG. 6 is a block diagram showing a fifth embodiment of the present invention.

This embodiment is based on the third embodiment, but it is possible to provide a similar system which is based on the fourth embodiment.

The embodiment comprises a mode judging circuit 900, which receives the perceptually weighting signal of each frame from the perceptually weighting circuit 230 and outputs mode data to an excitation quantizer 600. The mode judging circuit 900 judges the mode by using a feature quantity of the present frame. The feature quantity may be a frame average pitch prediction gain. The pitch prediction gain may be computed as:

$$G = 10\log_{10}\left[1 / L \sum_{i=1}^{L} (P_i / E_i)\right] \tag{54}$$

where L is the number of sub-frames in the frame, $P_i$ is the speech power in an i-th sub-frame, and $E_i$ is the pitch predicted error power.

$$P_i = \sum_{n=0}^{N-1} x_{wi}^2(n) \tag{55}$$

-continued $$E_i = P_i - \left[\sum_{n=0}^{N-1} x_{wi}(n)x_{wi}(n-T)\right]^2 \Big/ \left[\sum_{n=0}^{N-1} x_{wi}^2(n-T)\right] \tag{56}$$

Here, T is an optimum delay which maximizes the prediction gain.

The mode judging circuit 900 sets up a plurality of different modes by comparing the frame average pitch prediction gain G with respective predetermined thresholds. The number of different modes may, for instance, be four. The mode judging circuity 900 outputs the mode data to the multiplexer 400 as well as to the excitation quantizer 700.

When a predetermined mode is represented by the received mode data, the excitation quantizer 700 executes the same operation as in the first excitation quantizer 500 shown in FIG. 4, and outputs the first excitation signal to a gain quantizer 750, while outputting codes representing the pulse positions and polarities to the mutiplexer 400. When the predetermined mode is not represented, it executes the same operation as in the second excitation quantizer 510 as shown in FIG. 4, and outputs the second excitation to the gain quantizer 750, while outputting codes representing the pulse positions and polarities to the multiplexer 400.

When the predetermined mode is represented, the gain quantizer 750 executes the same operation as in the gain quantizer 365. Otherwise, it executes the same operation as in the gain quantizer 530 shown in FIG. 1.

The embodiments described above may be modified variously. As an example, a codebook used for quantizing the amplitudes of a plurality of pulses, may be stored in advance by studying the speech signal. A method of storing a codebook through the speech signal study is described in, for instance, Linde et al., "An Algorithm for Vector Quantization Design", IEEE Trans. Commun., pp. 84–95, January 1980.

In lieu of the amplitude codebook, a polarity codebook may be provided, in which pulse polarity combinations corresponding in number to the number of bits equal to the number of pulses are prepared.

It is possible to obtain the positions of any number of pulses with gain variations and to switch adaptive codebook circuits or gain codebooks by using mode data.

For the pulse amplitude quantization, it is possible to arrange such as to preliminarily select a plurality of amplitude codevectors from the amplitude codebook 351 for each of a plurality of pulse groups each of L pulses and then permit the pulse amplitude quantization using the selected codevectors. This arrangement permits reducing the computational effort necessary for the pulse amplitude quantization.

As an example of the amplitude codevector selection, a plurality of amplitude codevectors are preliminarily selected and outputted to the excitation quantizer in the order of maximizing equation (57) or (58).

$$D_k = \left[\sum_{n=0}^{N-1} z(n) \sum_{i=1}^{L} g'_{ik}\delta(m_i)\right]^2 \tag{57}$$

$$D_k = \left[\sum_{n=0}^{N-1} z(n) \sum_{i=1}^{L} g'_{ik}\delta(m_i)\right]^2 \Big/ \left[\sum_{i=1}^{L} g'_{ik}\delta(m_i)\right]^2 \tag{58}$$

As has been described in the foregoing, according to the present invention, the positions of M non-zero amplitude pulses are retrieved with a different gain for each group of the pulses less in number than M. It is thus possible to increase the accuracy of the excitation and improve the performance compared to the prior art speech coders.

The present invention comprises a first excitation quantizer for retrieving the positions of M non-zero amplitude pulses which constitutes an excitation signal of the input speech signal with a different gain for each group of the pulses less in number than M, and a second excitation quantizer for retrieving the positions of a predetermined number of pulses by using the spectral parameters, judges the both distortion for selecting the better one, and uses better excitation in accordance with the feature time change of the speech signal to improve the characteristic.

In addition, according to the present invention a mode of the input speech may be judged by extracting a feature quantity therefrom, and the first and second excitation quantizers may be switched to obtain the pulse positions according to the judged mode. It is thus possible to use always use a good excitation corresponding to time changes in the feature quantity of the speech signal with less computational effort. The performance thus can be improved compared to the prior art speech coders.

Figure 7:
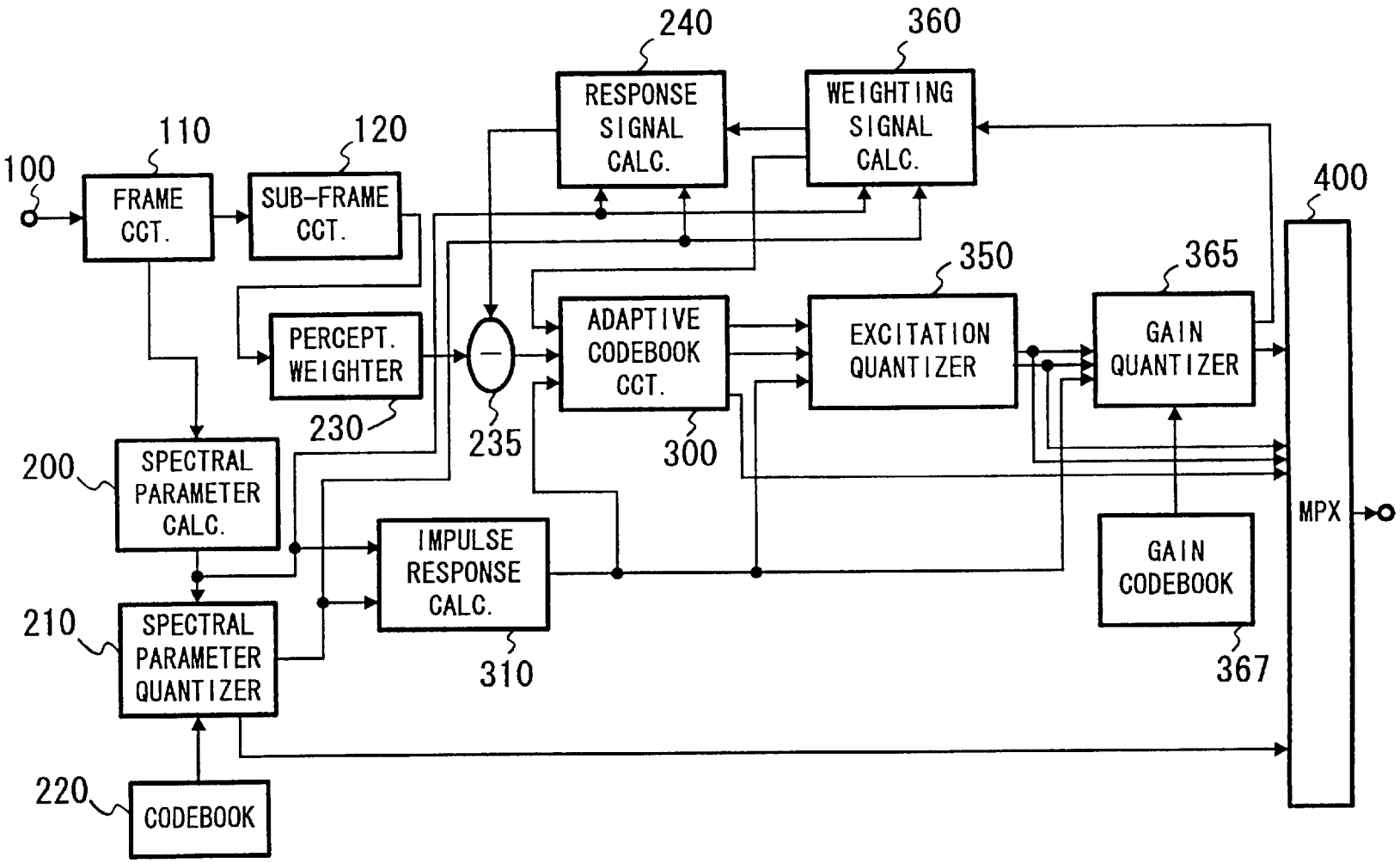
FIG. 7 is a block diagram showing a sixth embodiment of the speech coder according to the present invention.

FIG. 7 is a block diagram showing a sixth embodiment of the speech coder according to the present invention.

Referring to the figure, a frame circuit 110 splits a speech signal inputted from an input terminal 100 into frames (of 10 ms, for instance), and a sub-frame circuit 120 further splits each frame of speech signal into a plurality of shorter sub-frames (of 5 ms, for instance).

A spectral parameter computer 200 computes a spectral parameters of a predetermined order P (for instance, P=10) by cutting the speech signal with a window longer than the sub-frame length (for instance 24 ms) for each with respect to at least one sub-frame of speech signal. The spectral parameters may be calculated in a well-known process of LPC analysis, Burg analysis, etc. The spectral parameter computer 200 also converts linear prediction parameters $\alpha_i$ (i=1, . . . , 10) which have been obtained by the Burg process into LSP parameters suited for quantization or interpolation. For example, the spectral parameter computer 200 converts the linear prediction parameters obtained in the 2-nd sub-frame by the Brug process into LSP parameters, obtains the 1-st sub-frame LSP parameters by linear interpolation, inversely converts the 1-st sub-frame LSP parameters thus obtained into linear prediction parameters, and outputs the linear prediction parameters $\alpha_{il}$ (i=1, . . . , 10, l=1, . . . , 2) of the 1-st and 2-nd sub-frames to a perceptual weighter 230, while outputting the 2-nd sub-frame LSP parameters to a spectral parameter quantizer 210.

The spectral parameter quantizer 210 efficiently quantizes LSP parameters of predetermined sub-frames by using a codebook 220, and outputs quantized LSP parameters which minimizes a distortion given as equation (1).

In the following description, it is also assumed that the vector quantization is used as the quantization and the 2-nd sub-frame LSP parameters is quantized as described before.

The spectral parameter quantizer 210 also restores the 1-st sub-frame LSP parameters from the 2-nd sub-frame quantized LSP parameters. In the instant case, the 1-st sub-frame LSP parameters are restored by linear interpolation between the 2-nd sub-frame quantized LSP parameters of the present frame and the 2-nd sub-frame quantized LSP parameters of the immediately preceding frame. Here, the 1-st sub-frame LSP parameters are restored by the linear interpolation after selecting a codevector which minimizes the error power between the non-quantized and quantized LSP parameters.

The spectral parameter quantizer 210 converts the restored 1-st sub-frame LSP parameters and the 2-nd sub-frame quantized LSP parameters into the linear prediction parameters $\alpha_{il}$ (i=1, . . . , 10, l=1, . . . , 2) for each sub-frame, and outputs the result of the conversion to an impulse response computer 310, while outputting an index representing the 2-nd sub-frame quantized LSP parameters codevector to a mutiplexer 400.

The perceptual weighter 230 receives each sub-frame non-quantized linear prediction parameters $\alpha_i$ (i=1, . . . , P) from the spectral parameter computer 200, perceptual-weights the sub-frame speech signal according to Literature 1, and outputs a perceptually weighted signal thus obtained.

A response signal computer 240 receives each sub-frame linear prediction parameters $\alpha_i$ and also each sub-frame linear prediction coefficient $\alpha_i'$, having been restored by quantization and interpolation, from the spectral parameter computer 200 and the spectral parameter quantizer 210, computes a response signal corresponding to an input signal of d(n)=0 for one sub-frame by using stored filter memory data, and outputs the computed response signal to a subtractor 235. The response signal $x_z(n)$ is expressed as equation (2). When $n-1 \leqq 0$, equations (3) and (4) are used.

The subtractor 235 subtracts the response signal from the perceptually weighted signal for one sub-frame, and outputs the difference $x_w'(n)$ to an adaptive codebook circuit 300.

The impulse response calculator 310 calculates the impulse response $h_w(n)$ of the perceptually weighting filter executes the z transform equation (6), for a predetermined number L of points, and outputs the result to the adaptive codebook circuit 300 and also to an excitation quantizer 350.

The adaptive codebook circuit 300 receives the past excitation signal v(n) from the weighting signal calculator 360, the output signal $x'_w(n)$ from the subtractor 235 and the perceptually weighted impulse response $h_w(n)$ from the impulse response calculator 310, determines a delay T corresponding to the pitch such as to minimize the distortion expressed by equation (7). It also obtains the gain β by equation (9).

In order to improve the delay extraction accuracy for women's speeches and children's speeches, the delay may be obtained as decimal sample values rather than integer samples.

The adaptive codebook circuit 300 makes the pitch prediction according to equation (10) and outputs the prediction error signal $z_w(n)$ to the excitation quantizer 350.

An excitation quantizer 350 provides data of M pulses. The operation in the excitation quantizer 350 is shown in the flow chart of FIG. 2.

Figure 8:
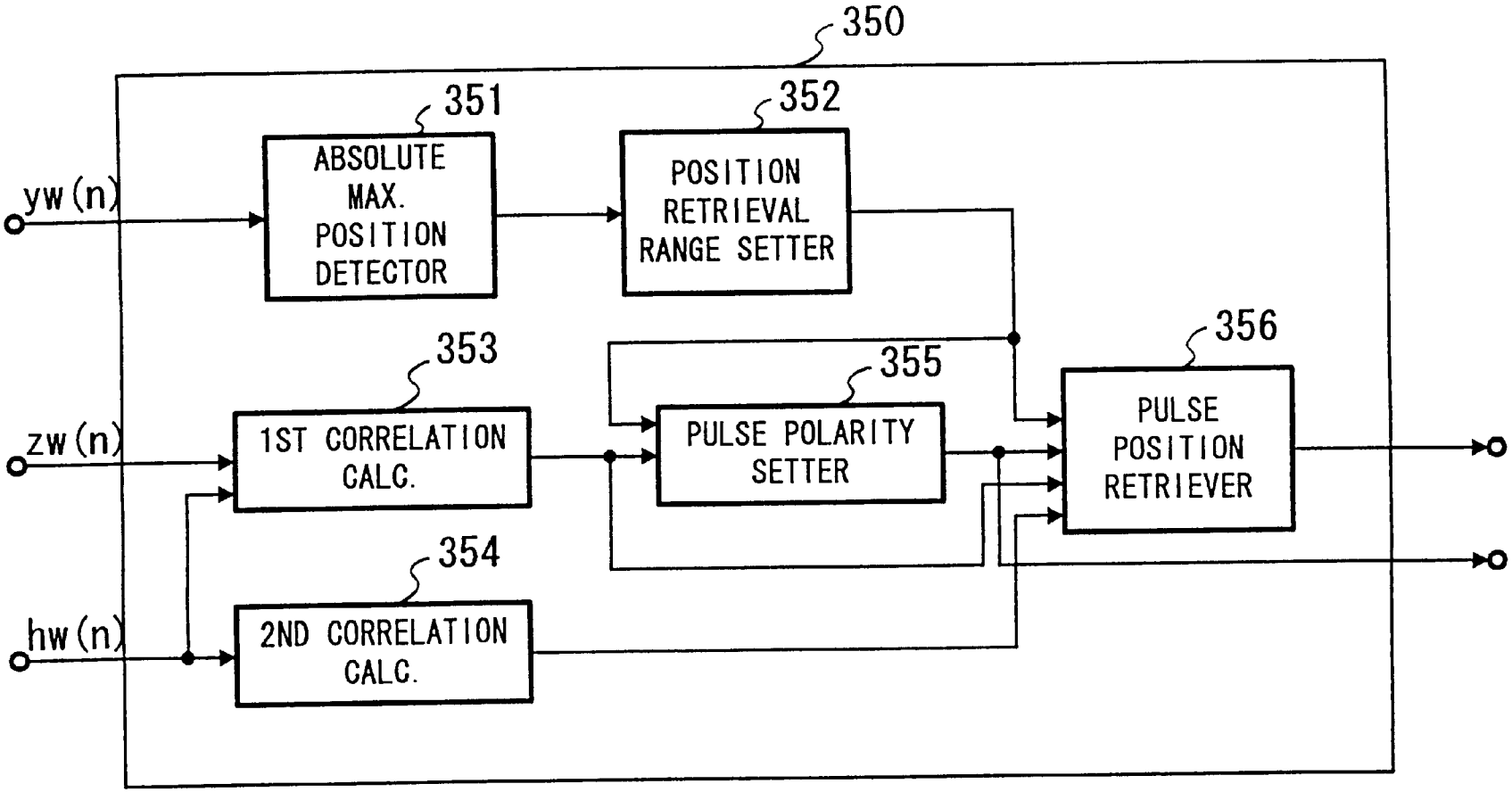
FIG. 8 is a block diagram showing the construction of the excitation quantizer 350.

FIG. 8 is a block diagram showing the construction of the excitation quantizer 350.

An absolute maximum position detector 351 detects a sample position, which meets a predetermined condition with respect to a pitch prediction signal $y_w(n)$. In this embodiment, the predetermined condition is that "the absolute amplitude is maximum", and the absolute maximum position detector 351 detects a sample position which meets this condition, and outputs the detected sample position data to a position retrieval range setter 352.

The position retrieval range setter 352 sets a retrieval range of each sample position after shifting the input pulse position by a predetermined sample number L toward the future or past.

As an example, where five pulses are to be obtained in a 5-ms sub-frame (40 samples), with an input sample position D, position candidates contained in the retrieval ranges of these pulses are:

1-st pulse: D−L, D−L+5, . . .

2-nd pulse: D−L+1, D−L+6, . . .

3-rd pulse: D−L+2, L+7, . . .

4-th pulse: D−L+3, L+8, . . .

5-th pulse: D−L+4, L+9, . . .

Then, $z_w(n)$ and $h_w(n)$ are inputted, and a first and a second correlation computers 353 and 354 compute a first and a second correlation function d(n) and φ, respectively, using equations (12) and (13).

A pulse polarity setter 355 extracts the polarity of the first correlation function d(n) for each pulse position candidates in the retrieval range set by the position retrieval range setter 352.

A pulse position retriever 356 executes operation on the following equation with respect to the above position candidate combinations, and selects a position which maximizes the same equation (14) as an optimum position.

If the number of pulses is M, equation (15) and (16) are employed. The pulse polarities used have been preliminarily extracted by the pulse polarity setter 355. In the above operation, polarity and position data of the M pulses are outputted to a gain quantizer 365.

Each pulse position is quantized with a predetermined number of bits to produce a corresponding index, which is outputted to the multiplexer 400. The pulse polarity data is also outputted to the multilexer 400.

The gain quantizer 365 reads out the gain codevectors from a gain codebook 367, selects a gain codevector which minimizes the following equation, and finally selects a combination of an amplitude codevector and a gain codevector which minimizes the distortion.

It is now assumed that three different excitation gains G' represented by adaptive codebook gain β' and pulses are vector quantized at a time.

$$D_t = \sum_{n=0}^{N-1}\left[x_w(n) - \beta_t' v(n-T) * h_w(n) - G_t' \sum_{k=1}^{M} \mathrm{sign}(k) h_w(n-m_k)\right]^2 \tag{59}$$

Denoted $\beta_t'$ and $G_t'$ are t-th elements of three-dimensional gain codevectors stored in the gain codebook 367. The gain quantizer 365 selects a gain codevector which minimizes the distortion $D_t$ by executing the above computation with each gain codevector, and outputs the index of the selected gain codevector to the multiplexer 400.

The weighting signal computer 360 receives each index, reads out the corresponding codevector, and obtains a drive excitation signal V(n) given as:

$$v(n) = \beta_t' v(n-T) + G_t' \sum_{k=1}^{M} \mathrm{sign}(k)\delta(n-m_k) \tag{60}$$

V(n) being outputted to the adaptive codebook circuit 300.

The weighting signal computer 360 then computes the response signal $s_w(n)$ for each sub-frame from the output parameters of the spectral parameter computer 200 and the spectral parameter quantizer 210 by using the following equation, and outputs the computed response signal to the response signal computer 240.

Figure 9:
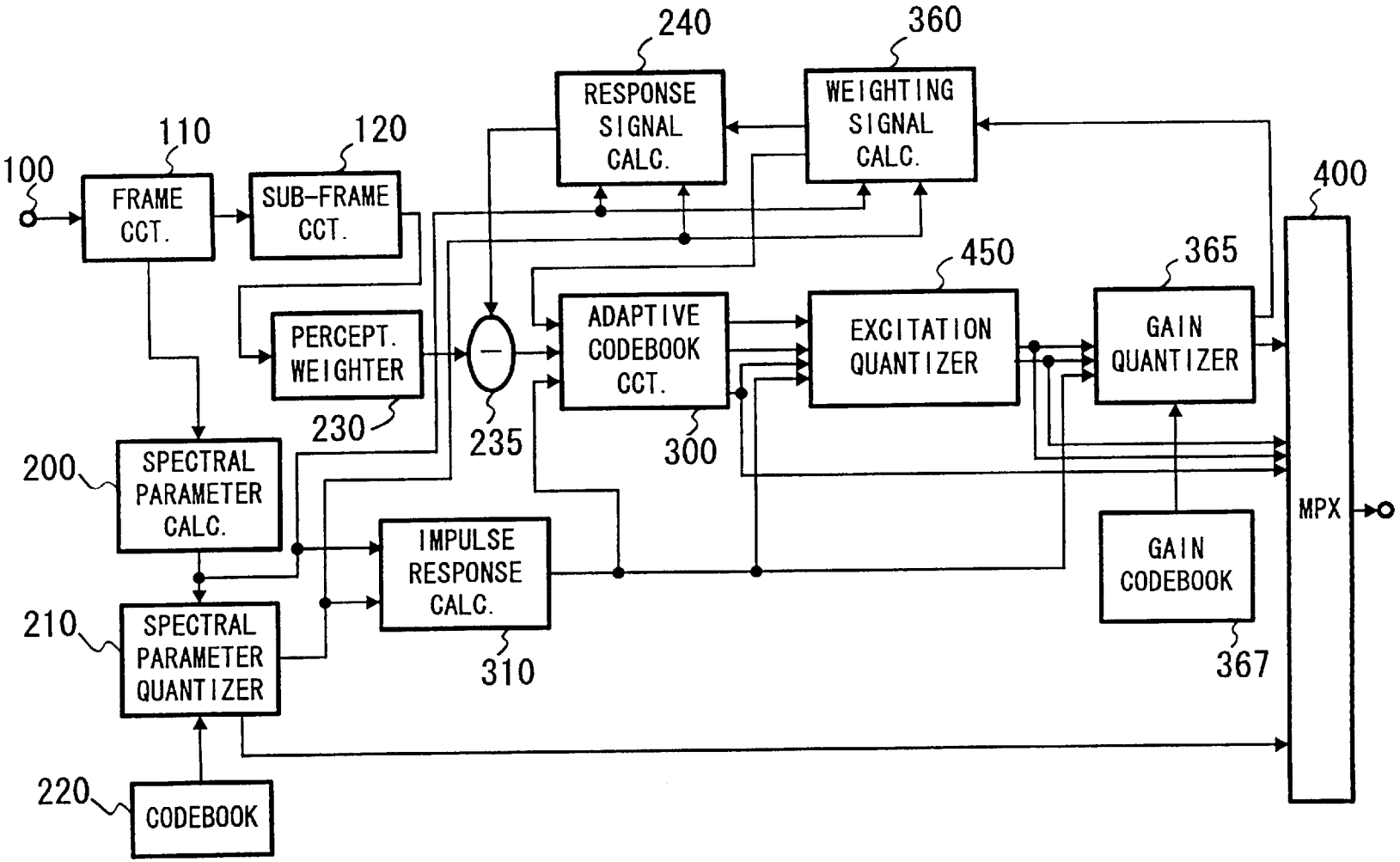
FIG. 9 is a block diagram showing a second embodiment of the present invention.

FIG. 9 is a block diagram showing a seventh embodiment of the present invention. This embodiment comprises an excitation quantizer 450, which is different in operation form that in the embodiment shown in FIG. 7.

Figure 10:
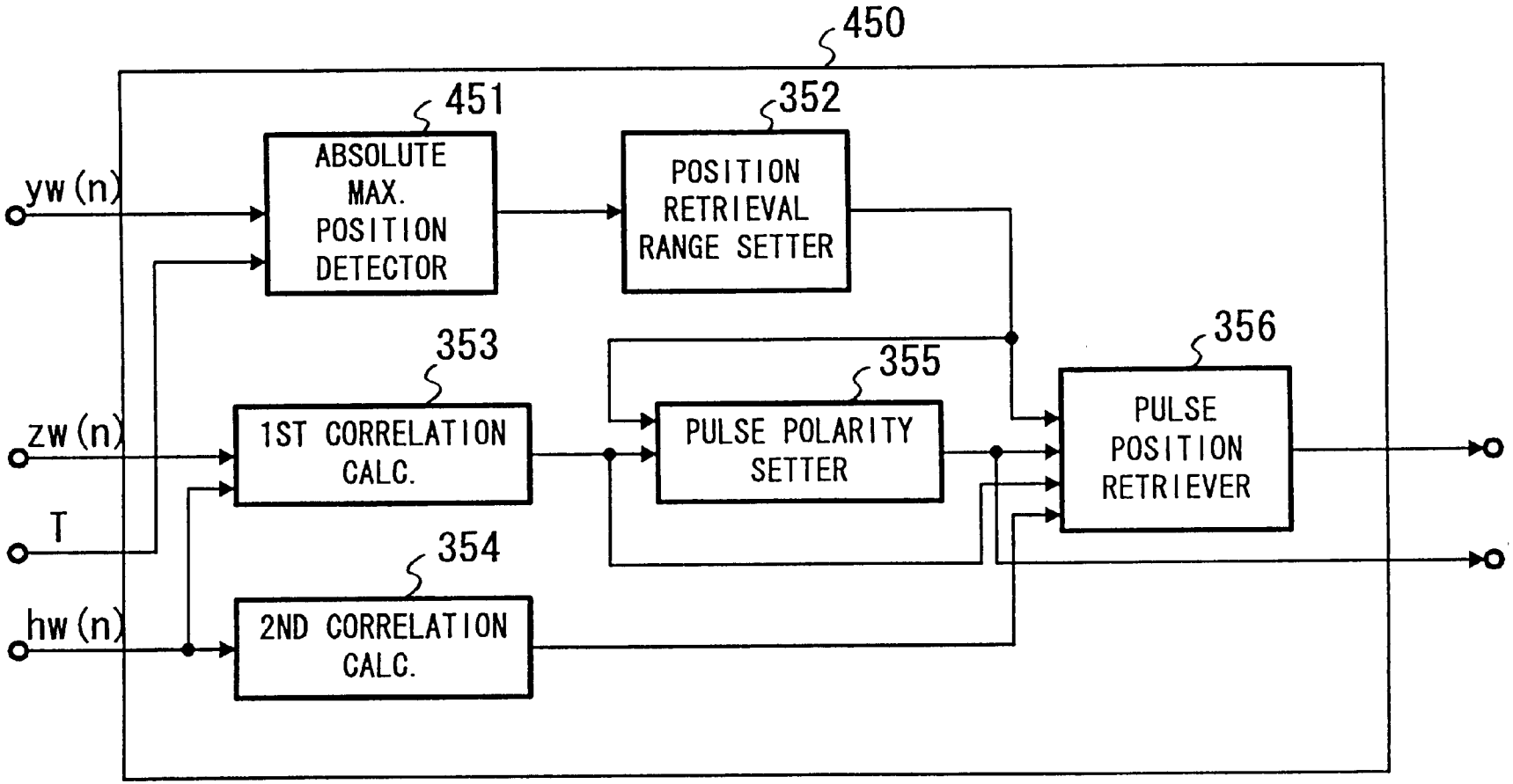
FIG. 10 shows the construction of the excitation quantizer 450.

FIG. 10 shows the construction of the excitation quantizer 450. The excitation quantizer 450 receives an adaptive codebook delay T as well as the prediction signal $y_w(n)$, the prediction error signal $z_w(n)$, and the perceptually weighted pulse response $h_w(n)$.

An absolute maximum position computer 451 receives delay time data T corresponding to the pitch period, detects a sample position which corresponds to the maximum absolute value of the pitch prediction signal $y_w(n)$ in a range form the sub-frame forefront up to a sample position after the delay time T, and outputs the detected sample position data to the position retrieval range setter 352.

Figure 11:
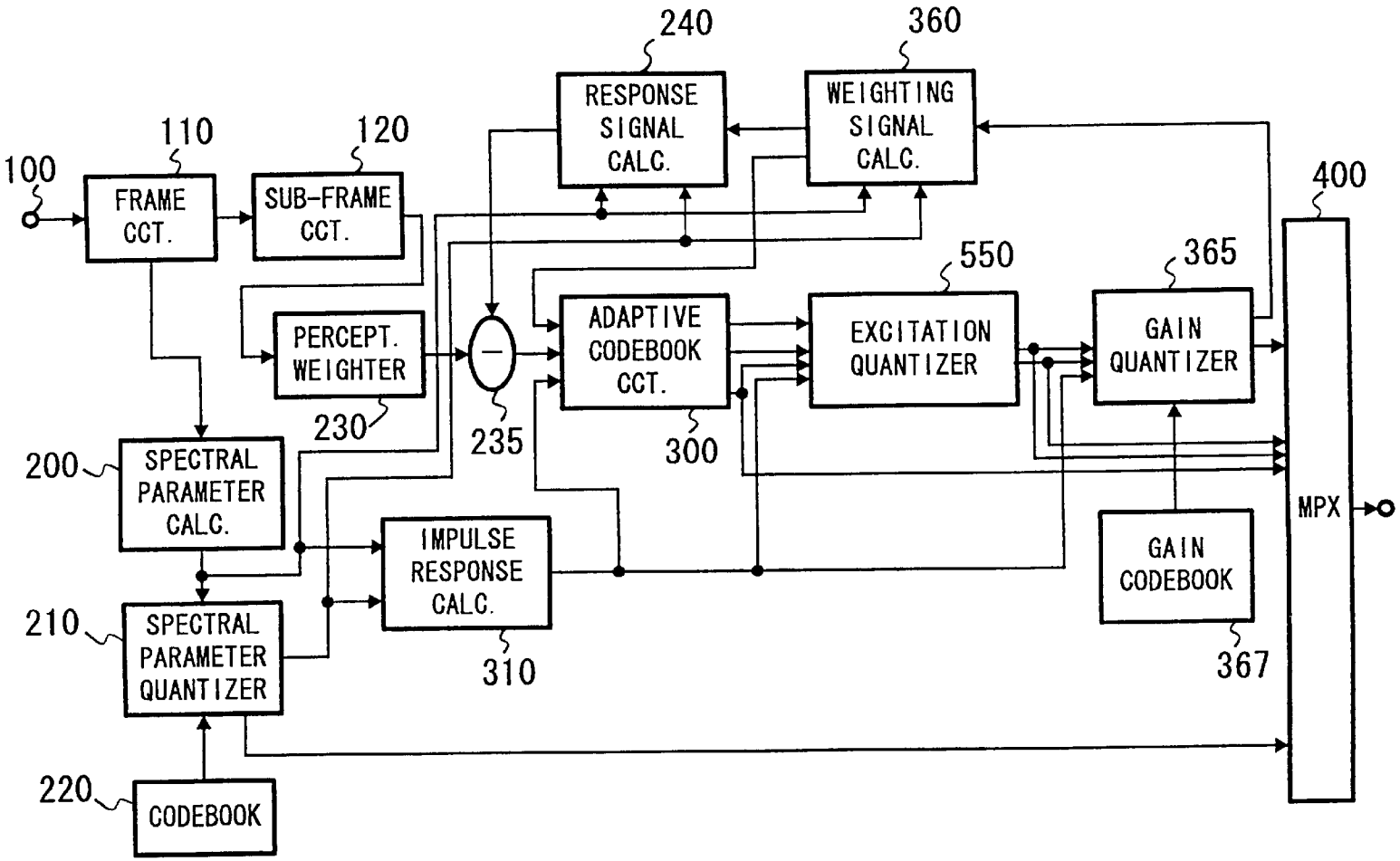
FIG. 11 is a block diagram showing an eighth embodiment of the present invention.
Figure 12:
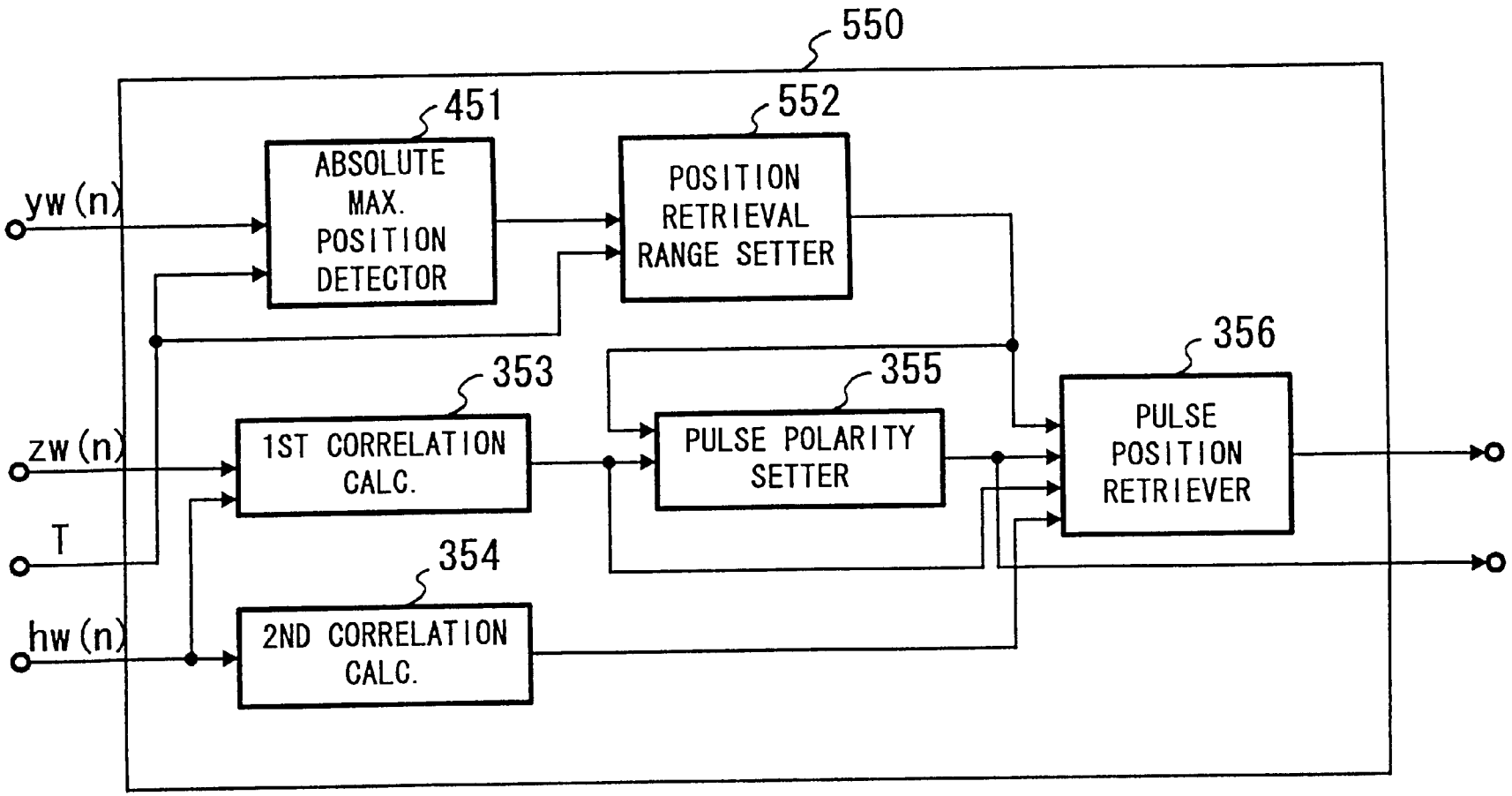
FIG. 12 shows the construction of the excitation quantizer 550.

FIG. 11 is a block diagram showing an eighth embodiment of the present invention. This embodiment uses an excitation quantizer 550, which is different in operation from the excitation quantizer 450 shown in FIG. 9. FIG. 12 shows the construction of the excitation quantizer 550.

A position retrieval range setter 552 sets position candidates of pulses through the delay by the delay time T positions, which are obtained by shifting input sample positions by a predetermined sample number L to the future or past.

Figure 13:
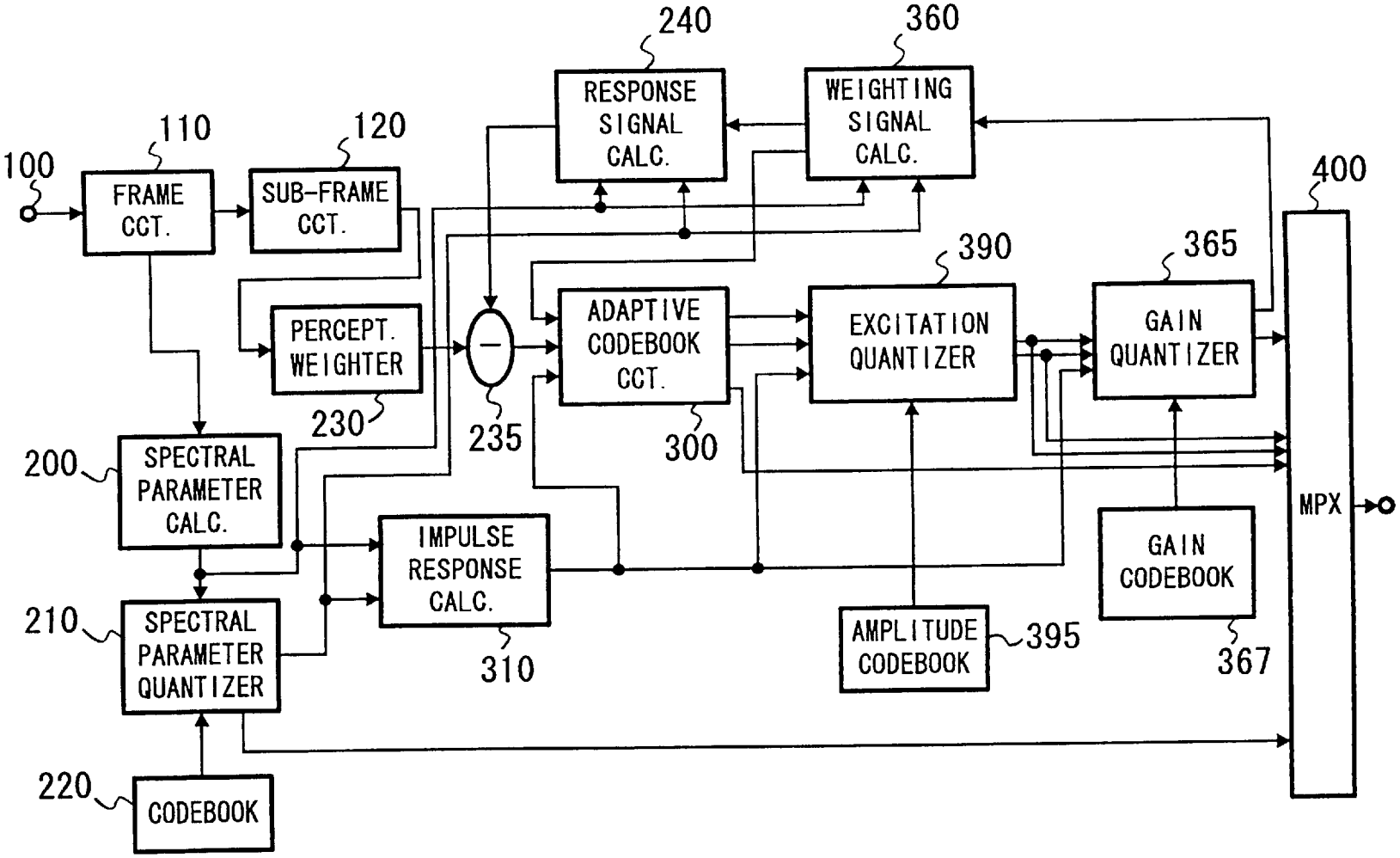
FIG. 13 is a block diagram showing a ninth embodiment of the present invention.

As an example, where five pulses are to be obtained in a 5-ms sub-frame (40 samples), with an input sample position D, position candidates of the pulses are:

1-st pulse: D−L, D−L+T, 2-nd pulse: D−L+1, D=L+T, 3-rd pulse: D=L+2, D−L+T, 4-th pulse: D=L+3, D−L+T, 5-th pulse: D=L+4, D−L+T, FIG. 13 is a block diagram showing a ninth embodiment of the present invention. This embodiment is a modification of the sixth embodiment obtained by adding an amplitude codebook. The seventh and eighth embodiments may be modified likewise by adding an amplitude codebook.

Figure 14:
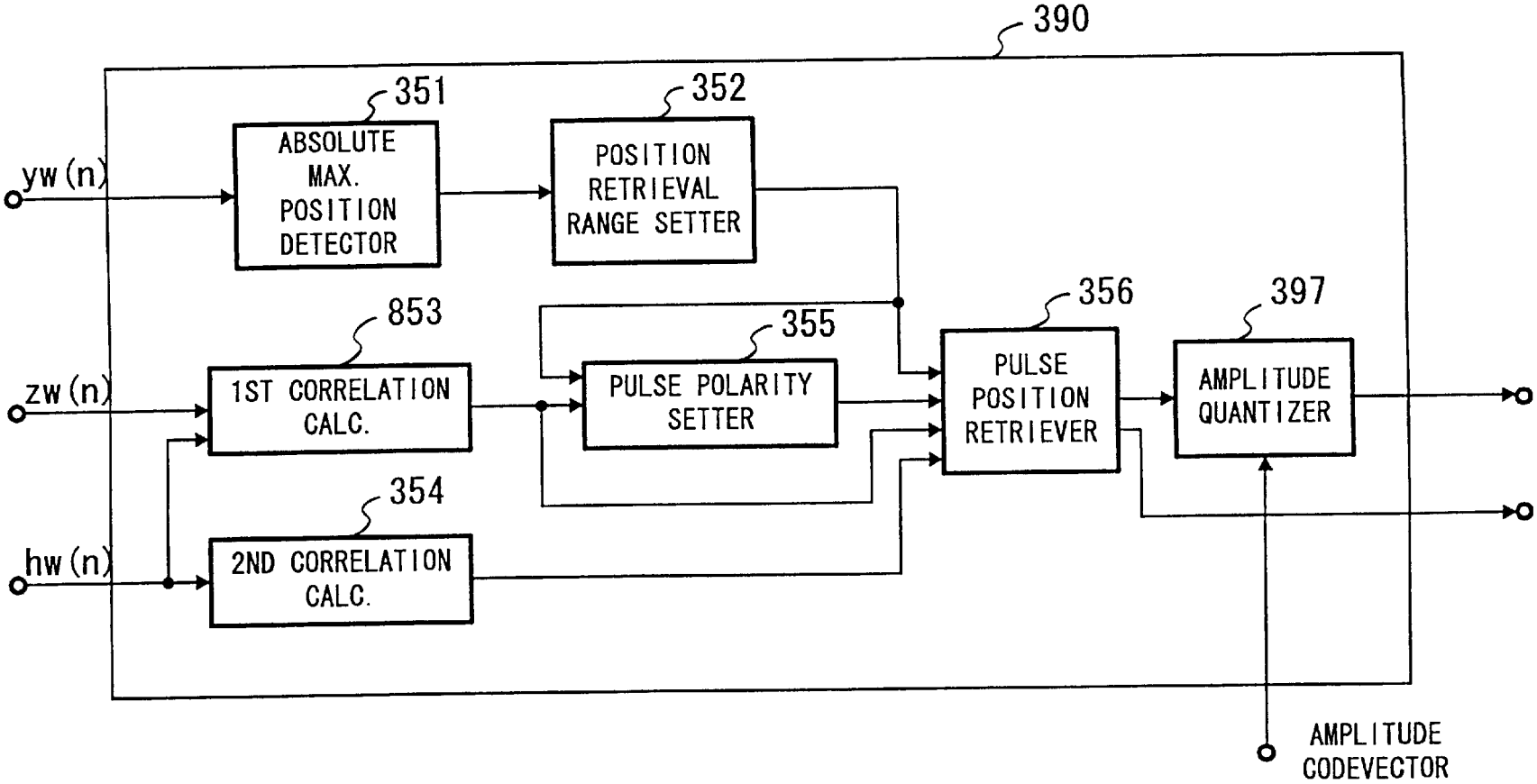
FIG. 14 shows the construction of the excitation quantizer 390.

The difference of FIG. 13 from FIG. 7 resides in an excitation quantizer 390 and an amplitude codebook 395. FIG. 14 shows the construction of the excitation quantizer 390. In this embodiment, pulse amplitude quantization is made by using the amplitude codebook 395.

In the pulse position retriever 356, after the positions of M pulses have been determined, an amplitude quantizer 397 selects an amplitude codevector which maximizes the equations (22), (23) and the following equation (61) from the amplitude codebook 395, and outputs the index of the selected amplitude codevector.

$$E_j = \sum_{k=1}^{M} g'^2_{kj}\phi(m_k, m_k) + 2\sum_{k=1}^{M-1}\sum_{i=k+1}^{M} g'_{kj}g'_{ij}\phi(m_k, m_i) \tag{61}$$

where $g_{kj}'$ is a j-th amplitude codevector of a k-th pulse.

The pulse position quantizer 390 outputs an index representing the selected amplitude codevector and also outputs the position data and amplitude codevector data to the gain quantizer 365.

While the amplitude codebook is used in this embodiment, it is possible to use instead a polarity codebook showing the polarities of pulses for the retrieval.

Figure 15:
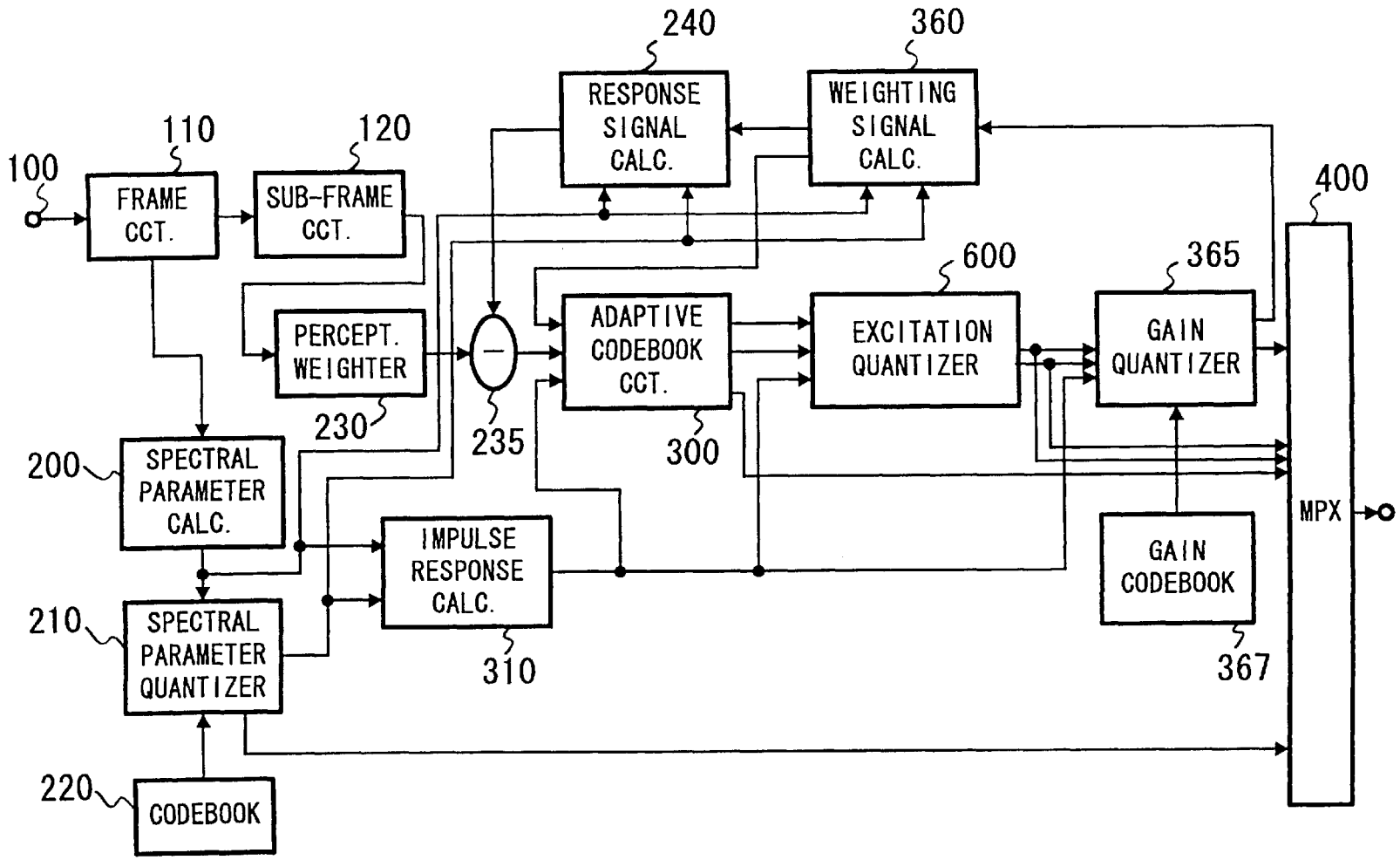
FIG. 15 is a block diagram showing a fifth embodiment of the present invention.

FIG. 15 is a block diagram showing a tenth embodiment of the present invention. This embodiment uses an excitation quantizer 600 which is different in operation for the excitation quantizer 350 shown in FIG. 7. The construction of the excitation quantizer 600 will now be described with reference to FIG. 16.

Figure 16:
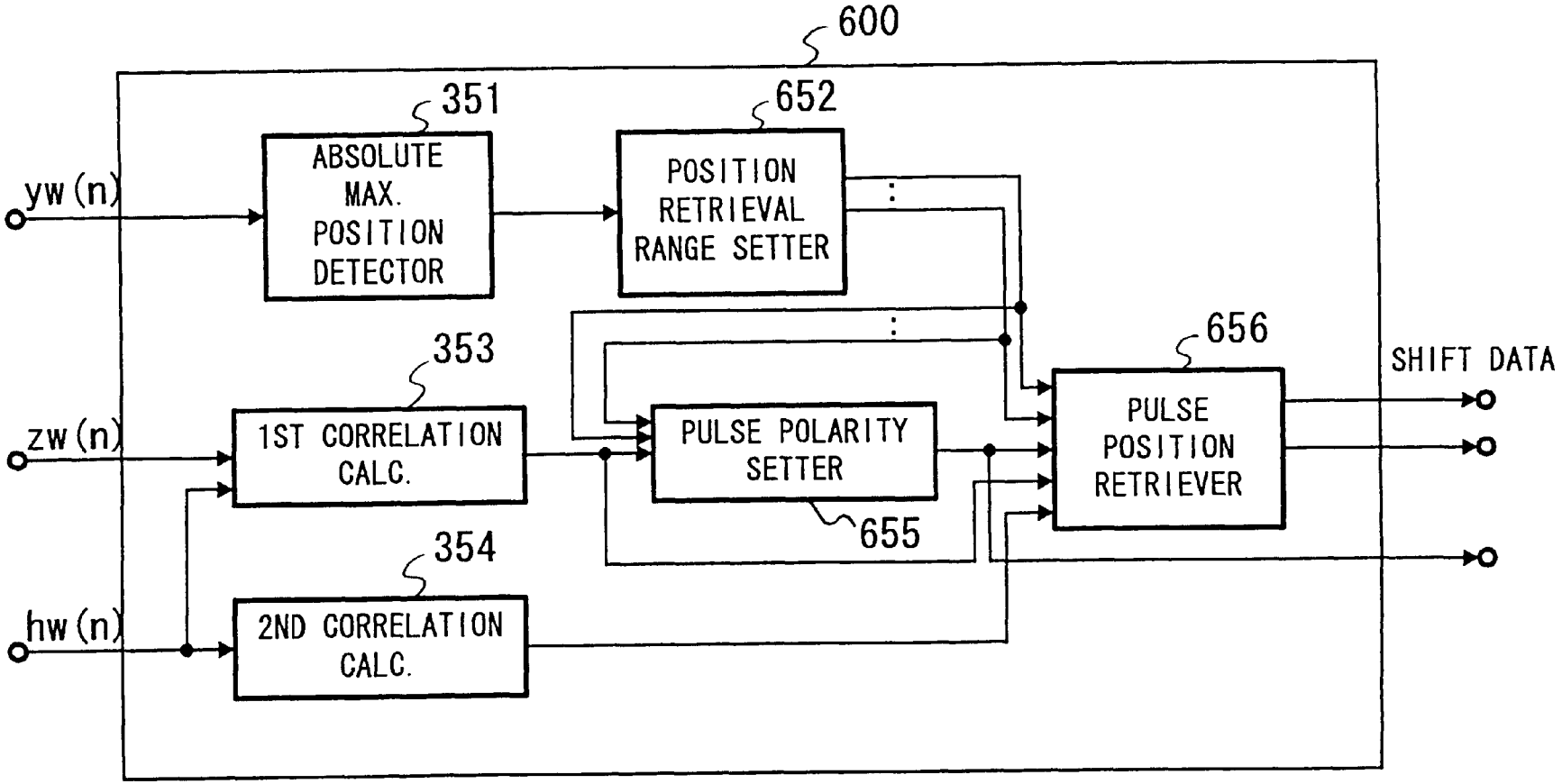
FIG. 16 is a block diagram showing the construction of the excitation quantizer 600.

FIG. 16 is a block diagram showing the construction of the excitation quantizer 600. A position retrieval range setter 652 shifts, by a plurality of (for instance Q) different shifting extents, a position represented by the output data of the absolute maximum position detector 351, sets retrieval ranges and pulse position sets of each pulse with respect to the respective shifted positions, and outputs the pulse position sets to a pulse polarity setter 655 and a pulse retriever 650.

The pulse polarity setter 655 extracts polarity data of each of a plurality of position candidates received from the position retriever 652, and outputs the extracted polarity data to the pulse position retriever 656.

The pulse position retriever 656 retrieves for a position, which maximizes equation (14), with respect to each of the plurality of position candidates by using the first and second correlation functions and the polarity. The pulse position retriever 656 selects the position which maximizes equation (14) by executing the above operation Q times, corresponding to the number of the different shifting extents, and outputs position and shifting extent data of the pulses, while also outputting the shifting extent data to the multiplexer 400.

Figure 17:
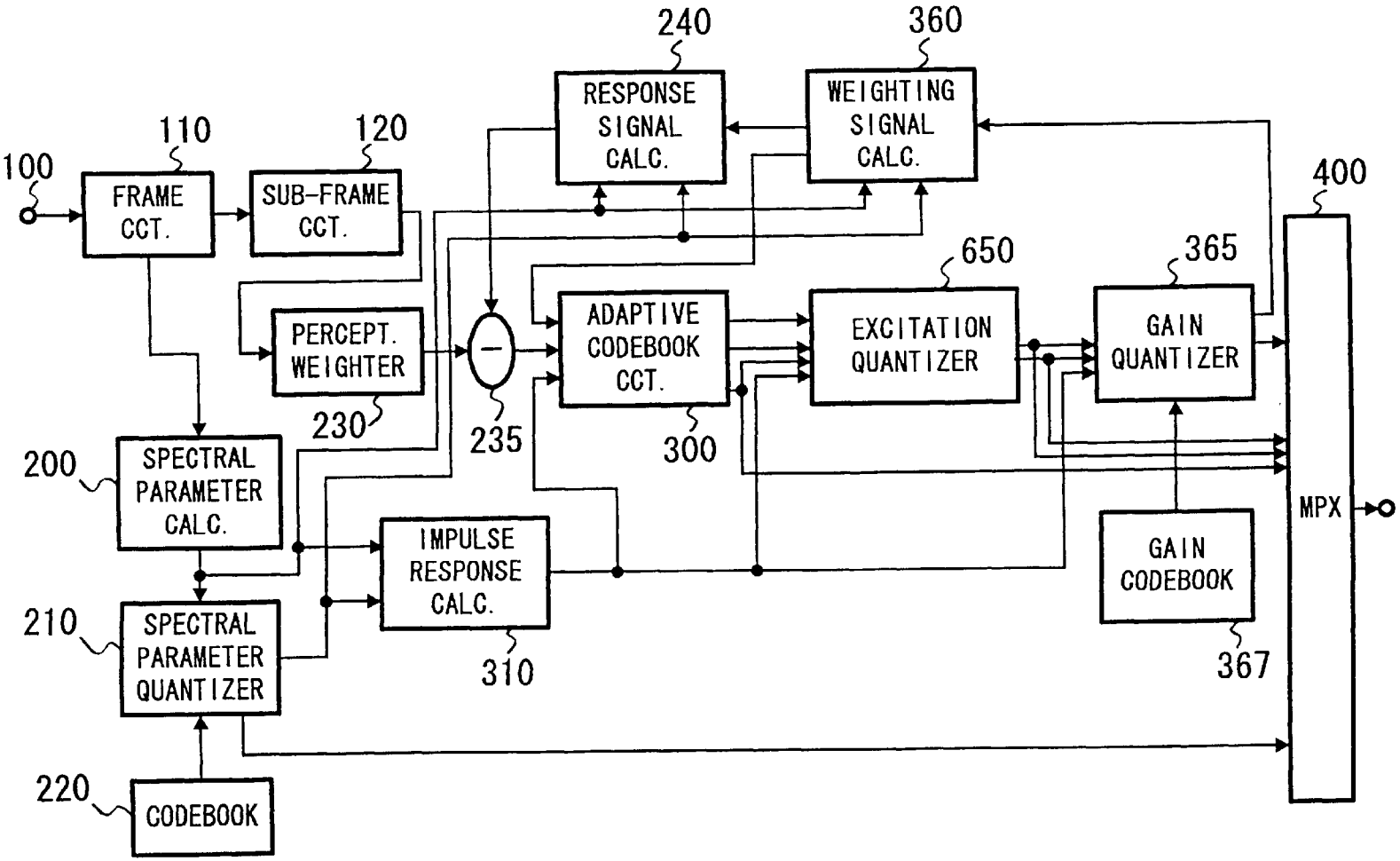
FIG. 17 is a block diagram showing an eighth embodiment of the present invention.

FIG. 17 is a block diagram showing an eleventh embodiment of the present invention. This embodiment uses an excitation quantizer 650 which is different in operation from the excitation quantizer 650 shown in FIG. 7. The construction of the excitation quantizer 650 will now be described with reference to FIG. 18.

Figure 18:
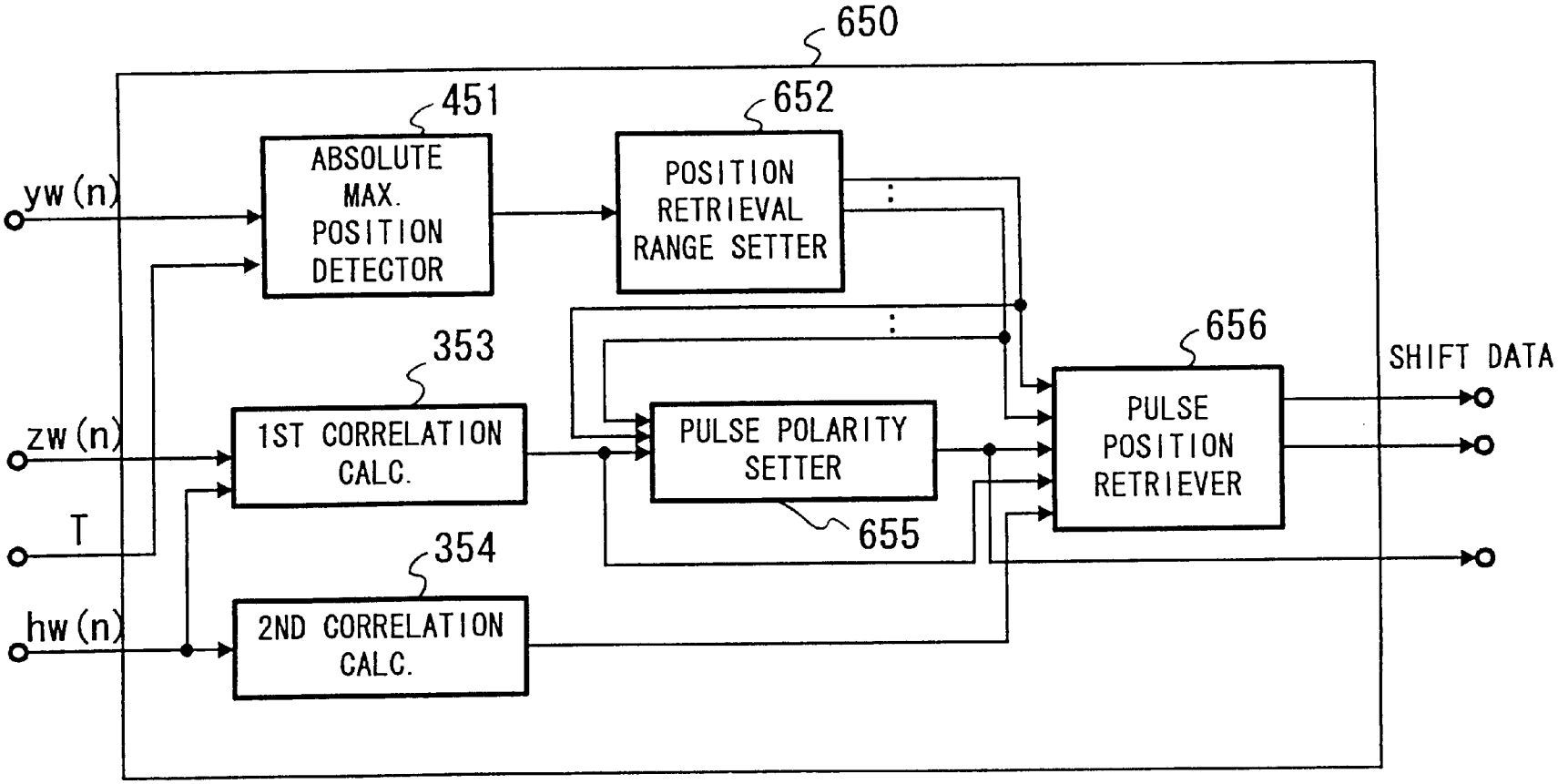
FIG. 18 is a block diagram showing the construction of the excitation quantizer 650.

FIG. 18 is a block diagram showing the construction of the excitation quantizer 650.

A position retrieval range setter 652 sets positions of each pulse with respect to positions, which are obtained by shifting by a plurality of (for instance Q) shift extents a position represented by the output data of the absolute maximum position detector 451, and outputs pulse position sets corresponding in number to the number of the shifting extents to a pulse polarity setter 655 and a pulse position retriever 656.

The pulse polarity setter 655 extracts polarity data of each of a plurality of position candidates outputted from the position retriever 652, and extracts the extracted polarity data to the pulse position retriever 656.

The pulse position retriever 656 retrieves for a position which maximizes equation (14) by using the first and second correlation functions and the polarity. The pulse position retriever 656 finally selects the position which maximizes equation (14) with Q different kinds by executing the above operation Q times corresponding to the number of the different shifting extents, and outputs pulse position and shifting extent data, while also outputting the shifting extent data to the multiplexer 400.

Figure 19:
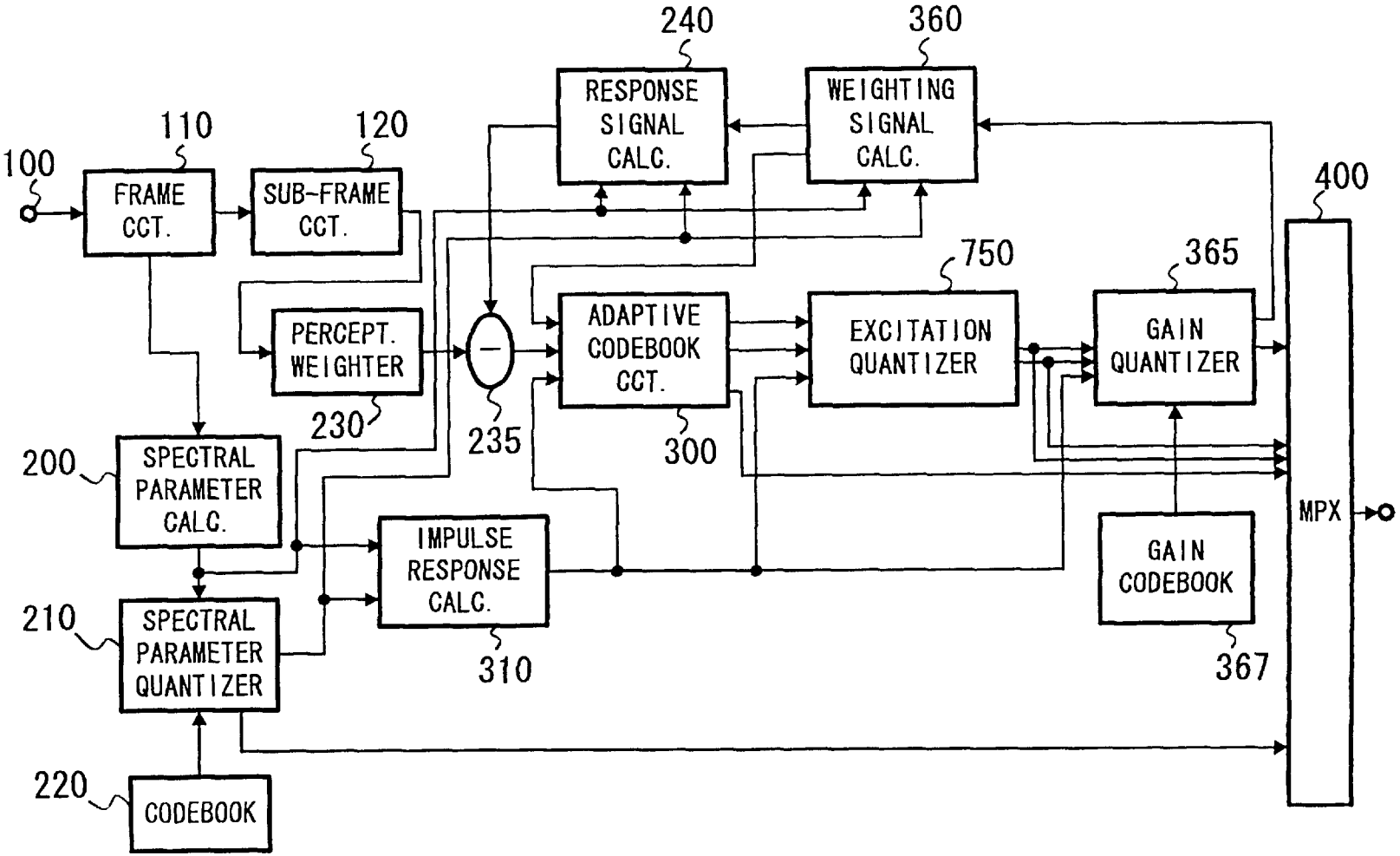
FIG. 19 is a block diagram showing a twelfth embodiment of the present invention.

FIG. 19 is a block diagram showing a twelfth is embodiment of the present invention. This embodiment uses an excitation quantizer 750 which is different in operation from the excitation quantizer 350 shown in FIG. 11. The construction of the excitation quantizer 750 will now be described with reference to FIG. 20.

Figure 20:
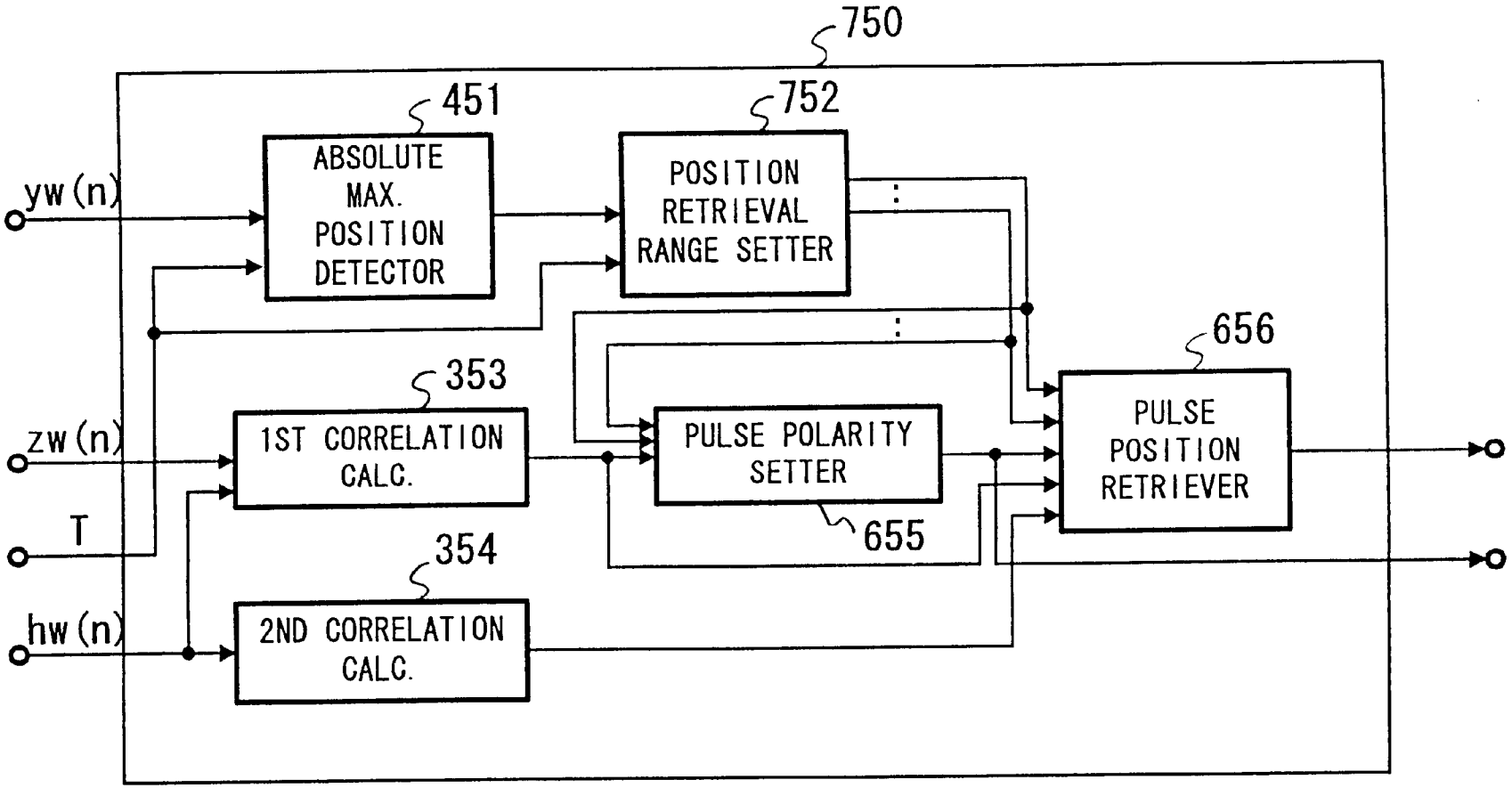
FIG. 20 is a block diagram showing the construction of the excitation quantizer.

FIG. 20 is a block diagram showing the construction of the excitation quantizer.

A position retrieval range setter 752 sets positions of each pulse by delaying positions, which are obtained by shifting by a plurality of (for instance Q) shifting extents a position represented by the output data of the absolute maximum position detector 451, by a delay time T. The position retrieval range setter 752 thus outputs position sets of each pulse corresponding in number to the number of the different shifting extents to a pulse polarity setter 655 and a pulse position retriever 656.

The pulse polarity setter 655 extracts polarity data of each of a plurality of position candidates from the position retriever 652, and outputs the extracted polarity data to the pulse position retriever 656.

The pulse position retriever 656 retrieves for a position which maximizes equation (14) by using the first and second correlation functions and the polarity. The pulse position retriever 656 selects the position which maximizes equation (14) by executing the above operation Q times corresponding to the number of the different shifting extents, and outputs pulse position and shifting extent data to the gain quantizer 365, while outputting the shifting extent data to the multiplexer 400.

Figure 21:
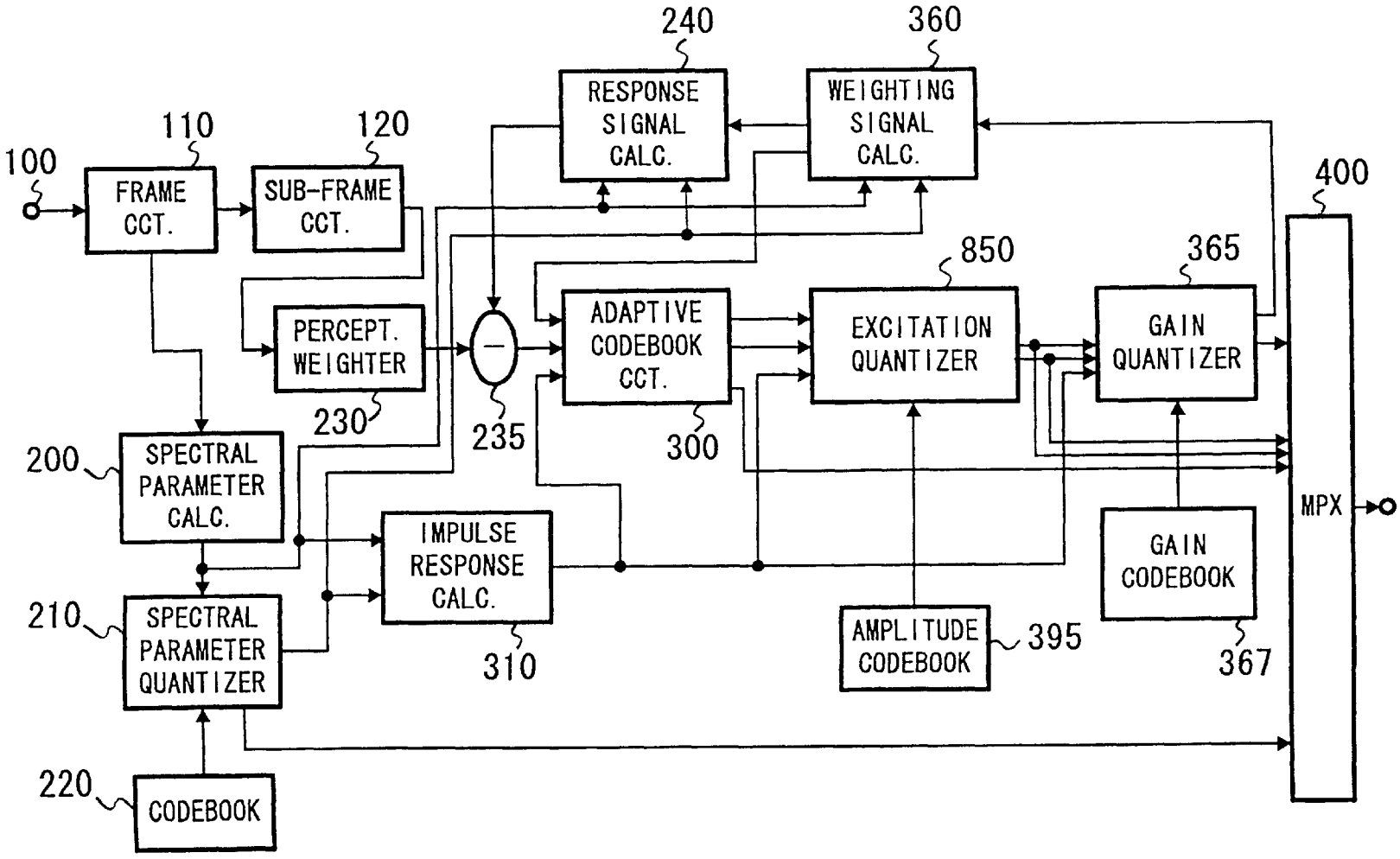
FIG. 21 is a block diagram showing a thirteenth embodiment of the present invention.

FIG. 21 is a block diagram showing a thirteenth embodiment of the present invention. This embodiment is obtained as a modification of the fifth embodiment by adding an amplitude codebook for pulse amplitude quantization, but it is possible to obtain modifications of the eleventh and twelfth embodiments likewise.

This embodiment uses an excitation quantizer 850 which is different in operation from the excitation quantizer 390 shown in FIG. 13. The construction of the excitation quantizer 850 will now be described with reference to FIG. 22.

Figure 22:
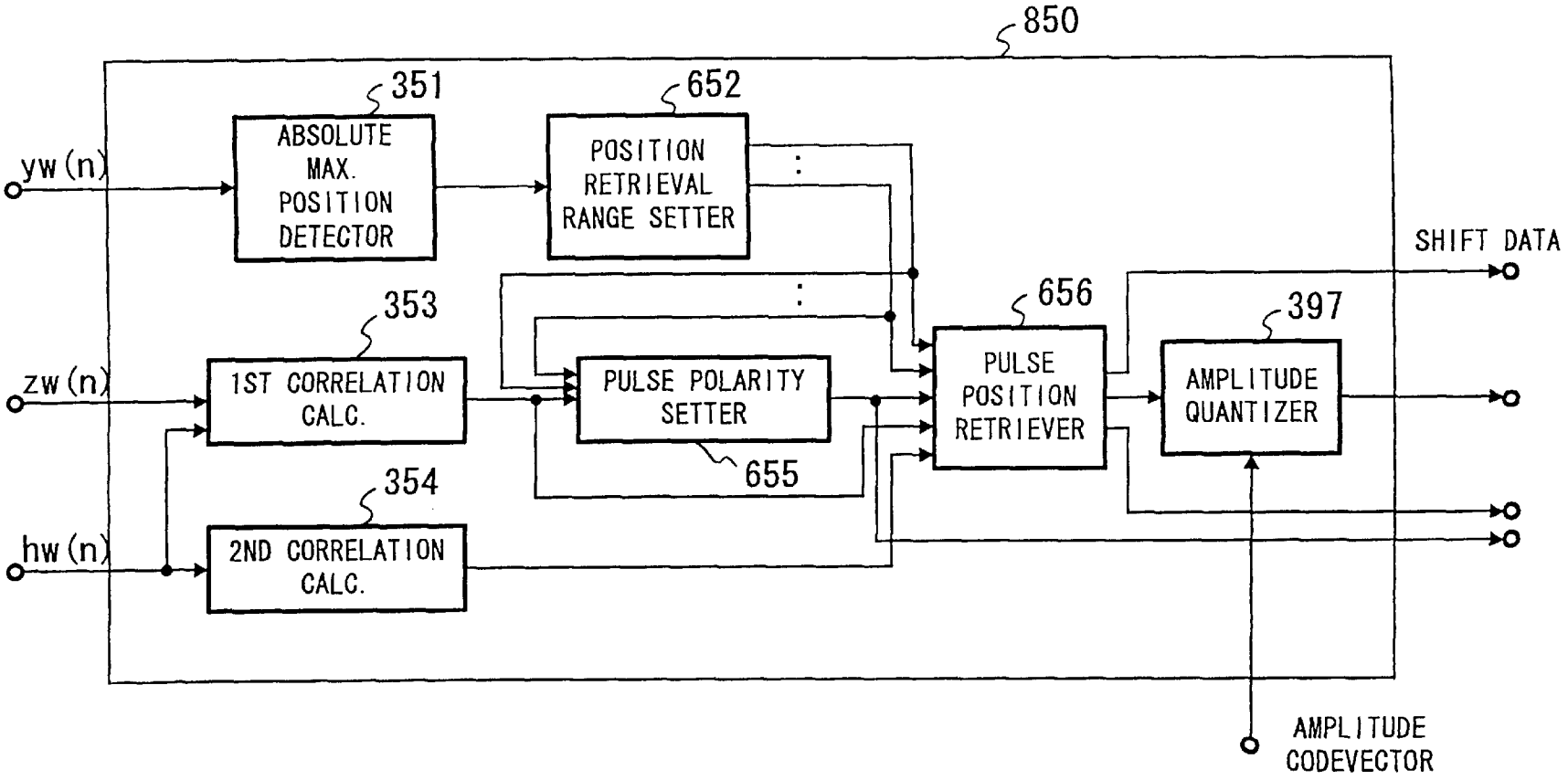
FIG. 22 is a block diagram showing the construction of the excitation quantizer 850.

FIG. 22 is a block diagram showing the construction of the excitation quantizer 850.

A position retrieval range setter 652 sets positions of each pulse with respect to positions, which are obtained by shifting by a plurality of different (for instance Q) shifting extents a position represented by the output data of the absolute maximum position detector 351, and outputs pulse position sets corresponding in number to the number of the different shifting extents to a pulse polarity setter 655 and a pulse position retriever 656.

The pulse polarity setter 655 extracts polarity data of each of a plurality of position candidates of the position retriever 652 and outputs the extracted polarity data to the pulse position retriever 656.

The pulse position retriever 656 retrieves for a position for maximizing equation (14) with respect to each of a plurality of position candidates by using the first and second correlation functions and the polarity. The pulse position retriever 656 selects the position which maximizes equation (14) by executing the above operation Q times corresponding in number to the number of the different shifting extents, and outputs pulse position and shifting extent data to the gain quantizer 365, while also outputting the shifting extent data to the multiplexer 400. An amplitude quantizer 397 is the same in operation as the one shown in FIG. 14.

Figure 23:
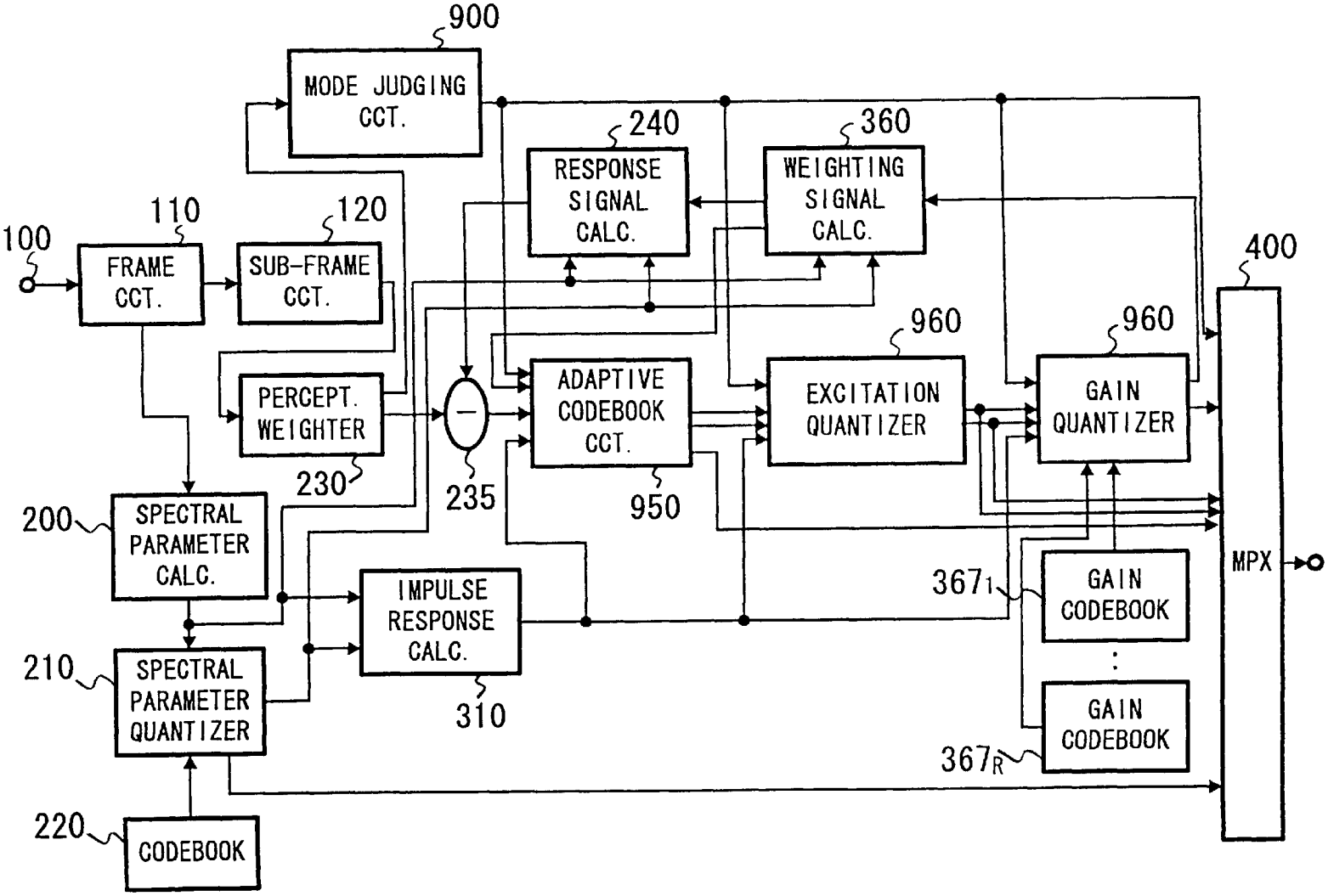
FIG. 23 is a block diagram showing a fourteenth embodiment of the present invention.

FIG. 23 is a block diagram showing a fourteenth embodiment of the present invention. This embodiment is based on the first embodiment, but it is possible to obtain its modifications which are based on other embodiments.

A mode judging circuit 900 receives the perceptually weighted signal in units of frames from the perceptually weighting circuit 230, and outputs mode data to an adaptive codebook circuit 950, an excitation quantizer 960 and a gain quantizer 965 as well as to the multiplexer 400. As the mode data, a feature quantity of the present frame is used. As the feature quantity, the frame average pitch prediction gain is used. The pitch prediction gain may be computed by using an equation:

$$G = 10\log_{10}\left[1/L\sum_{i=1}^{L}(P_i/E_i)\right] \tag{62}$$

where L is the number of sub-frames contained in the frame, and $P_i$ and $E_i$ are the speech power and the pitch prediction error power in an i-th frame, respectively given as:

$$P_i = \sum_{n=0}^{N-1} x_{wi}^2(n) \tag{63}$$

and $$E_i = P_i - \left[\sum_{n=0}^{N-1} x_{wi}(n)x_{wi}(n-T)\right]^2 \Big/ \left[\sum_{n=0}^{N-1} x_{wi}^2(n-T)\right] \tag{64}$$

where T is the optimum delay corresponding to the maximum prediction gain.

The mode judging circuit 900 judges a plurality of (for instance R) different modes by comparing the frame average pitch prediction gain G with corresponding threshold values. The number R of the different modes may be 4.

When the outputted mode data represents a predetermined mode, the adaptive codebook circuit 950 receiving this data executes the same operation as in the adaptive codebook 300 shown in FIG. 7, and outputs a delay signal, an adaptive codebook prediction signal and a prediction error signal. In the other modes, it directly outputs its input signal from the subtractor 235.

At the same time, that is, in the above predetermined mode, the excitation quantizer 960 executes the same operation as in the excitation quantizer 350 shown in FIG. 7.

The gain quantizer 965 switches a plurality of gain codebooks $\mathbf{367}_1$ to $\mathbf{367}_R$, which are designed for each mode, to be used for gain quantization according to the received mode data.

The embodiments described above are by no means limitative, and various changes and modifications are possible. For example, a codebook for amplitude quantizing a plurality of pulses may be preliminarily studied and stored by using a speech signal. A codebook study method is described in, for instance, Linde et al, "An algorithm for Vector Quantization Design", IEEE Trans. Commun., pp. 84–95, January 1980.

As an alternative to the amplitude codebook, a polarity codebook may be used, in which pulse polarity combinations corresponding in number to the number of bits equal to the number of pulses are stored.

As has been described in the foregoing, according to the present invention the excitation quantizer obtains a position meeting a predetermined condition with respect to a pitch prediction signal obtained in the adaptive codebook, sets a plurality of pulse position retrieval ranges for respective pulses constituting an excitation signal, and retrieves these pulse position retrieval ranges for the best position. It is thus possible to provide a satisfactory excitation signal, which represents a pitch waveform, by synchronizing the pulse position retrieval ranges to the pitch waveform. Satisfactory sound quality compared to the prior art system is thus obtainable with a reduced bit rate.

In addition, according to the present invention, the excitation quantizer may perform the above process in a predetermined mode among a plurality of different modes, which are judged from a feature quantity extracted from the input speech. It is thus possible to improve the sound quality for positions of the speech corresponding to modes, in which the periodicity of the speech is strong.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A speech coder comprising a spectral parameter computer for obtaining a plurality of spectral parameters from an input speech signal, and quantizing the spectral parameters thus obtained, and an excitation quantizer for retrieving positions of M non-zero amplitude pulses which constitutes an excitation signal of the input speech signal with a different gain for each set of the pulses for each group of pulses less in number than M.

2. A speech coder according to claim 1, wherein the excitation quantizer includes a codebook for jointly quantizing the amplitudes or polarities of a plurality of pulses.

3. A speech coder comprising a spectral parameter computer for obtaining a plurality of spectral parameters from an input speech signal, and quantizing the spectral parameters thus obtained, an excitation quantizer for retrieving positions of M non-zero amplitude pulses which constitutes an excitation signal of the input speech signal with a different gain for each group of the pulses less in number than M, and a second excitation quantizer for retrieving the positions of a predetermined number of pulses by using the spectral parameters, the outputs of the first and second excitation quantizers being used to compute distortions of the speech so as to select the less distortion one of the first and second excitation quantizers.

4. A speech coder according to claim 3, wherein the excitation quantizer includes a codebook for jointly quantizing the amplitudes or polarities of a plurality of pulses.

5. The speech coder according to claim 3, which further comprises a mode judging circuit for obtaining a feature quantity from the input speech signal, judging one of a plurality of different modes from the obtained feature quantity and outputting mode data, the first and second excitation quantizers being used switchedly according to the mode data.

6. The speech coder according to claim 4, which further comprises a mode judging circuit for obtaining a feature quantity from the input speech signal, judging one of a plurality of different modes from the obtained feature quantity and outputting mode data, the first and second excitation quantizers being used switchedly according to the mode data.

7. A speech coder comprising a spectral parameter computer for obtaining spectral parameters from an input speech signal and quantizing the spectral parameters thus obtained, an impulse response computer for computing impulse responses corresponding to the spectral parameters, a first correlation computer for computing correlations of the input signal and the impulse response, a second correlation computer for computing correlations among the impulse responses, a first pulse data computer for computing positions of first pulses from the outputs of the first and second correlation computers, a third correlation computer for correcting the output of the first correlation computer by using the output of the first pulse data computer, and a second pulse data computer for computing positions of second pulses from the outputs of the third and second correlation computers, the pulse data computation being made by executing the correlation correction and the pulse data computation iteratedly a predetermined number of times.

8. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-zero amplitude pulses, obtaining a sample position corresponding to a pulse position meeting a predetermined condition with respect to the computed pitch prediction signal, setting a pulse position retrieval range on the basis of a position obtained by shifting the obtained sample position by a predetermined number of samples, retrieving a best position in the pulse position retrieval range thus set, and outputting data of the retrieved best position.

9. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-zero amplitude pulses, obtaining a sample position meeting a predetermined condition with respect to the pitch prediction signal in a time interval equal to the pitch period from the forefront of a frame, setting a pulse position retrieval range for retrieving a pulse position on the basis of a position obtained by shifting the obtained sample position by a predetermined number of samples, retrieving a best position in the pulse position retrieval range thus set, and outputting data of the retrieved best position.

10. The speech coder according to claim 9, wherein the excitation quantizer includes a codebook for jointly quantizing the amplitudes or polarities of a plurality of pulses.

11. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-amplitude pulses, obtaining a sample position corresponding to a pulse position meeting a predetermined condition with respect to the computed pitch prediction signal in a time interval equal to the pitch period from the forefront of a frame, setting pulse position candidates through shifting the obtained sample position by the pitch period on the basis of the position shifted by predetermined numbers of samples from the sample position, retrieving the position candidates for a best position, and outputting data of the retrieved best position.

12. The speech coder according to claim 8, wherein the excitation quantizer includes a codebook for jointly quantizing the amplitudes or polarities of a plurality of pulses.

13. The speech coder according to claim 11, wherein the excitation quantizer includes a codebook for jointly quantizing the amplitudes or polarities of a plurality of pulses.

14. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-zero amplitude pulses, obtaining a sample position meeting a predetermined condition with respect to the computed pitch prediction signal, setting a plurality of pulse position retrieval ranges on the basis of positions obtained by shifting the obtained sample position by corresponding shift extents, making retrieval of the pulse position retrieval ranges to select a best combination of a shift extent and a pulse position, and outputting data of the selected best combination.

15. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-zero amplitude pulses, obtaining a sample pulse position meeting a predetermined condition with respect to the computed pitch prediction signal in a time interval equal to the pitch period from the forefront of a frame, setting a plurality of pulse position retrieval ranges on the basis of positions obtained by shifting the obtained sample position by corresponding shift extents, making retrieval of the pulse position retrieval ranges to select a best combination of a shift extent and a pulse position, and outputting data of the selected best combination.

16. The speech coder according to claim 15, wherein the excitation quantizer includes a codebook for jointly quantizing the amplitudes or polarities of a plurality of pulses.

17. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for forming an excitation signal of the input speech signal with M non-zero amplitude pulses, obtaining a sample pulse position meeting a predetermined condition with respect to the computed pitch prediction signal in a time interval equal to the pitch period from the forefront of a frame, setting pulse position candidates through shifting the obtained sample position by the pitch period on the basis of the position shifted by predetermined numbers of samples from the sample position, retrieving the position candidates for a best position, and outputting data of the retrieved best position.

18. The speech coder according to claim 14, wherein the excitation quantizer includes a codebook for jointly quantizing the amplitudes or polarities of a plurality of pulses.

19. The speech coder according to claim 17, wherein the excitation quantizer includes a codebook for jointly quantizing the amplitudes or polarities of a plurality of pulses.

20. A speech coder comprising a spectral parameter computer for obtaining a plurality of spectral parameters from an input speech signal and quantizing the obtained spectral parameters, a mode judging means for extracting a characteristic amount from the input speech signal, judging a plurality of modes from the extracted feature quantity, and outputting mode data, an adaptive codebook means for obtaining a delay corresponding to a pitch period from the input speech signal, computing a pitch prediction signal, and making pitch prediction, and an excitation quantizer for forming an excitation signal of the input speech signal with M non-zero amplitude signals, obtaining a sample position meeting a predetermined condition with respect to the pitch prediction signal when the mode data represents a predetermined mode, setting a pulse position retrieval range on the basis of the obtained sample position, retrieving a best position in the pulse position retrieval range, and outputting data of the retrieved best position.

21. The speech coder according to claim 20, wherein the feature quantity is an average pitch prediction gain.

22. The speech coder according to claim 20, wherein the mode judging means judges the modes on the basis of comparison of the average pitch prediction gain with a plurality of threshold values.

23. A speech coder comprising a spectral parameter computer for obtaining a plurality of spectral parameters from an input speech signal and quantizing the obtained spectral parameters, an adaptive codebook means for obtaining a delay corresponding to a pitch period from the input speech signal, computing a pitch prediction signal, and executing pitch prediction, and an excitation quantizer for obtaining a position meeting a predetermined condition with respect to the pitch prediction signal computed in the adaptive codebook means, setting a plurality of pulse position retrieval ranges for respective pulses constituting an excitation signal, and retrieving the best positions of the pulses in the pulse position retrieval ranges.

* * * * *